US008518622B2

(12) United States Patent
Ogawa et al.

(10) Patent No.: US 8,518,622 B2
(45) Date of Patent: Aug. 27, 2013

(54) TONER, DEVELOPER, AND IMAGE FORMING METHOD

(75) Inventors: Satoshi Ogawa, Nara (JP); Daisuke Inoue, Shizuoka (JP); Daisuke Ito, Shizuoka (JP); Osamu Uchinokura, Shizuoka (JP); Junichi Awamura, Shizuoka (JP); Teruki Kusahara, Shizuoka (JP); Satoshi Kojima, Shizuoka (JP); Mamoru Hozumi, Miyagi (JP); Shoko Sato, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 13/159,566

(22) Filed: Jun. 14, 2011

(65) Prior Publication Data

US 2011/0305986 A1 Dec. 15, 2011

(30) Foreign Application Priority Data

Jun. 14, 2010 (JP) ..... 2010-134880

(51) Int. Cl.
*G03G 9/09* (2006.01)

(52) U.S. Cl.
USPC ..... 430/108.23; 430/108.1; 430/108.4; 430/109.1; 430/109.4; 430/118.6; 430/137.1

(58) Field of Classification Search
USPC ..... 430/108.1, 108.4, 108.23, 109.1, 430/109.4, 118.6, 137.1
See application file for complete search history.

(56) References Cited

U.S. PATENT DOCUMENTS

| | | | | |
|---|---|---|---|---|
| 4,870,164 | A | 9/1989 | Kuhne et al. | |
| 4,935,502 | A | 6/1990 | Kuhne et al. | |
| 2005/0008960 | A1* | 1/2005 | Yaguchi et al. | 430/108.1 |
| 2009/0068579 | A1 | 3/2009 | Ogawa et al. | |
| 2009/0155710 | A1 | 6/2009 | Aoki et al. | |
| 2009/0233204 | A1* | 9/2009 | Watanabe et al. | 430/108.4 |
| 2009/0233218 | A1* | 9/2009 | Ogawa | 430/137.2 |
| 2009/0291378 | A1* | 11/2009 | Hirose et al. | 430/107.1 |
| 2010/0227266 | A1 | 9/2010 | Ogawa et al. | |
| 2011/0076610 | A1 | 3/2011 | Ogawa et al. | |

FOREIGN PATENT DOCUMENTS

| | | |
|---|---|---|
| JP | 02-37949 | 8/1990 |
| JP | 06-230607 | 8/1994 |
| JP | 08-262799 | 10/1996 |
| JP | 3039191 | 3/2000 |
| JP | 3531433 | 3/2004 |
| JP | 2005-106932 | 4/2005 |

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A toner containing a binder resin, a colorant, and a releasing agent, wherein the colorant contains a mixed crystal of a C. I. PIGMENT YELLOW 185 and a C. I. PIGMENT YELLOW 139, and wherein a mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) in the toner is 95/5 to 50/50.

16 Claims, 3 Drawing Sheets

TONER, DEVELOPER, AND IMAGE FORMING METHOD

BACKGROUND OF THE INVENTION

1. Field of the Invention

The present invention relates to a yellow toner for use in image formation employing so-called electrophotography, including electrostatic copiers and laser beam printers, and a developer containing the toner, and an image forming method using the toner.

2. Description of the Related Art

Conventionally, in electrophotographic apparatuses and electrostatic image recording apparatuses, an electric or magnetic latent image is visualized using a toner. For example, in electrophotography, a latent electrostatic image is formed on a photoconductor, and then the latent electrostatic image is developed using a toner to thereby form a toner image. The toner image is usually transferred onto a transfer material such as paper, and then fixed on the transfer material by a method such as heating.

A method for producing a toner used for developing a latent electrostatic image is broadly classified into a pulverization method and a polymerization method.

In the pulverization method, a thermoplastic resin, a colorant, a charge control agent, an offset preventing agent and the like are melted and mixed so as to form a uniform dispersion, and the resultant composition is pulverized and classified to thereby produce a toner. According to the pulverization method, a toner having excellent properties to a certain degree can be produced, however, the particle size distribution thereof tends to be wider. In order to obtain a copy image having a high resolution and a high gradation, for example, it is necessary to remove fine powder particles each having a diameter of 5 μm or smaller, particularly 3 μm or smaller, and coarse powder particles each having a diameter of 20 μm or greater, and thus the pulverization method has a disadvantage in that the yield becomes very low. In addition, in the pulverization method, it is difficult to uniformly disperse a releasing agent, a pigment and the like in a thermoplastic resin. Moreover, the pulverization method has such a problem that the pigment is exposed to a surface of a toner due to pulverization, and the surface of the toner is unevenly charged, and charge distribution on the toner becomes broad, causing degradation in developing properties. Therefore, at present, the pulverization method cannot sufficiently respond to superior performances demanded for a toner.

On the other hand, in the polymerization method, a pulverization step and a kneading step can be omitted, thereby contributing greatly to cost saving, such as energy saving, shortening of production time, improvement of step yield, and the like. Moreover, by the polymerization method, the size of a toner particle is made smaller, and sharp particle size distribution can be easily obtained, compared to the pulverization method. Furthermore, the polymerization method greatly contributes to improvement of image quality. Thus, the polymerization method is a promising production method.

In electrophotography, there are demands for improvement of quality of full color images. To achieve the improvement of image quality, it is necessary for each toner to have a wide color reproduction range.

Moreover, to achieve the improvement of image quality without causing any problem, it is necessary to highly disperse, in a toner, a colorant having excellent transparency, light resistance, and heat resistance.

However, there are many problems in a colorant for yellow toner, which is required for full color image formation. For example, generally a dye is excellent in transparency, but poor in light resistance, causing problems in storage stability of an image. A pigment is superior in light resistance to such a dye. However, the light resistance of a pigment for yellow toner is not sufficient, compared to a copper phthalocyanine pigment used as a pigment for magenta toner.

Therefore, disazo compounds having excellent light resistance have been proposed (Japanese Patent Application Publication (JP-B) No. 02-37949). The proposed disazo compounds are a group of compounds, which are typified by C. I. PIGMENT YELLOW 180, and one of azo pigments having excellent light resistance, and heat resistance, and satisfying the recent demands for safety.

Moreover, a yellow toner using C. I. PIGMENT YELLOW 180 has been proposed (see Japanese Patent Application Laid-Open (JP-A) Nos. 06-230607, 06-266163, and 08-262799). However, in these proposed techniques, coloring performance is low, and transparency is far from excellent.

There is a proposal of a toner produced by a method of dispersing an oil phase in an aqueous phase using C. I. PIGMENT YELLOW 180, such as an emulsification dispersion method (JP-A No. 11-65172), or a suspension polymerization. However, since C. I. PIGMENT YELLOW 180 has relatively high hydrophilicity, there are such problems in these proposed techniques as segregation of C. I. PIGMENT YELLOW 180 on particle surfaces, and reaggregation inside the particles, causing difficulty in using C. I. PIGMENT YELLOW 180.

There is a proposal of a toner using C. I. PIGMENT YELLOW 185 of an isoindoline pigment (see JP-A No. 2005-106932). C. I. PIGMENT YELLOW 185 exhibits bright yellow color, involves less color fading, and is excellent in light resistance. However, C. I. PIGMENT YELLOW 185 has an absorption at 500 nm to 600 nm in a spectrum, thus C. I. PIGMENT YELLOW 185 is a yellow pigment strongly tinged with blue, and yellow color reproducibility is poor. For example, a* is largely shifted to a negative side on a*-b*coordinates in accordance with Japan Color which is printing color standards for offset printing.

Thus, a yellow toner having excellent transparency, light resistance, color reproducibility, such as chroma, hue, etc. and high coloring performance, and causing less background smear in long-term running at high temperature and high humidity has not been obtained. At present, there are demands for a yellow toner having excellent transparency, light resistance, and color reproducibility, such as chroma, hue, etc. and high coloring performance, and causing less background smear in long-term running at high temperature and high humidity, and a developer containing the toner, and an image forming method using the toner.

SUMMARY OF THE INVENTION

The present invention solves the conventional problems discussed above and provides a yellow toner having excellent transparency, light resistance, and color reproducibility, such as chroma, hue, etc. and high coloring performance, and causing less background smear in long-term running at high temperature and high humidity, and to provide a developer containing the toner, and an image forming method using the toner.

The invention described herein includes the following embodiments:

<1> A toner containing at least (i.e., comprising) a binder resin; a colorant; and a releasing agent, wherein the colorant comprises a mixed crystal of a C. I. PIGMENT YELLOW 185 and a C. I. PIGMENT YELLOW 139, and wherein a mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) in the toner is 95/5 to 50/50.

The present invention also provides the following embodiments:

<2> The toner according to <1>, wherein an amount of the colorant is 3 parts by mass to 15 parts by mass relative to 100 parts by mass of the binder resin.

<3> The toner according to <1> and <2>, wherein the toner is obtained by dispersing, in an aqueous medium, an oil phase containing at least the binder resin, the colorant, and the releasing agent.

<4> The toner according to any of the embodiments described above, especially <3>, wherein the dispersing the oil phase in the aqueous medium contains: dissolving or dispersing at least an active hydrogen group-containing compound, a polymer having a site reactive with the active hydrogen group-containing compound, an unmodified polyester resin, the colorant, and the releasing agent in an organic solvent, so as to form a dissolved or dispersed product, dispersing the dissolved or dispersed product in the aqueous medium, allowing the active hydrogen group-containing compound and the polymer having a site reactive with the active hydrogen group-containing compound to undergo crosslinking reaction or elongation reaction in the aqueous medium so as to obtain a dispersion liquid, and removing the organic solvent from the dispersion liquid, wherein each of the polymer having a site reactive with the active hydrogen group-containing compound, and the unmodified polyester resin is the binder resin.

<5> The toner according to any of the embodiments described above, especially <4>, wherein the unmodified polyester resin has an acid value of 5 KOHmg/g to 40 KOHmg/g.

<6> The toner according to any of the embodiments described above, especially <4> or <5>, wherein the colorant and the unmodified polyester resin are used as a masterbatch, which is formed by dispersing the colorant in the unmodified polyester resin in the dispersing the oil phase in the aqueous medium.

<7> The toner according to any of the embodiments described above, especially <6>, wherein the colorant is dispersed using a pigment dispersant.

<8> The toner according to any of the embodiments described above, especially <7>, wherein the pigment dispersant is a fatty acid ester.

<9> The toner according to any of the embodiments described above, especially <7> and <8>, wherein the pigment dispersant has a melting point of 70° C. to 110° C.

<10> The toner according to any of the embodiments described above, especially <7> to <9>, wherein an amount of the pigment dispersant is 1% by mass to 20% by mass relative to the masterbatch.

<11> The toner according to any of the embodiments described above, especially <6> to <10>, wherein the colorant is dispersed in the unmodified polyester resin by melting and kneading the colorant and the unmodified polyester resin using an open melt-kneader.

<12> A developer containing the toner according to any of <1> to <11>.

<13> An image forming method containing: forming a latent electrostatic image on a latent electrostatic image bearing member; developing the latent electrostatic image using the toner according to any of <1> to <11> so as to form a visible image; transferring the visible image onto a recording medium; and fixing the transferred image onto the recording medium.

According to the present invention, the conventional problems can be solved, and a yellow toner having excellent transparency, light resistance, color reproducibility, such as chroma, hue, etc. and high coloring performance, and causing less background smear in long-term running at high temperature and high humidity, and a developer containing the toner, and an image forming method using the toner, can be provided.

DETAILED DESCRIPTION OF THE INVENTION

Toner

Figure 1:
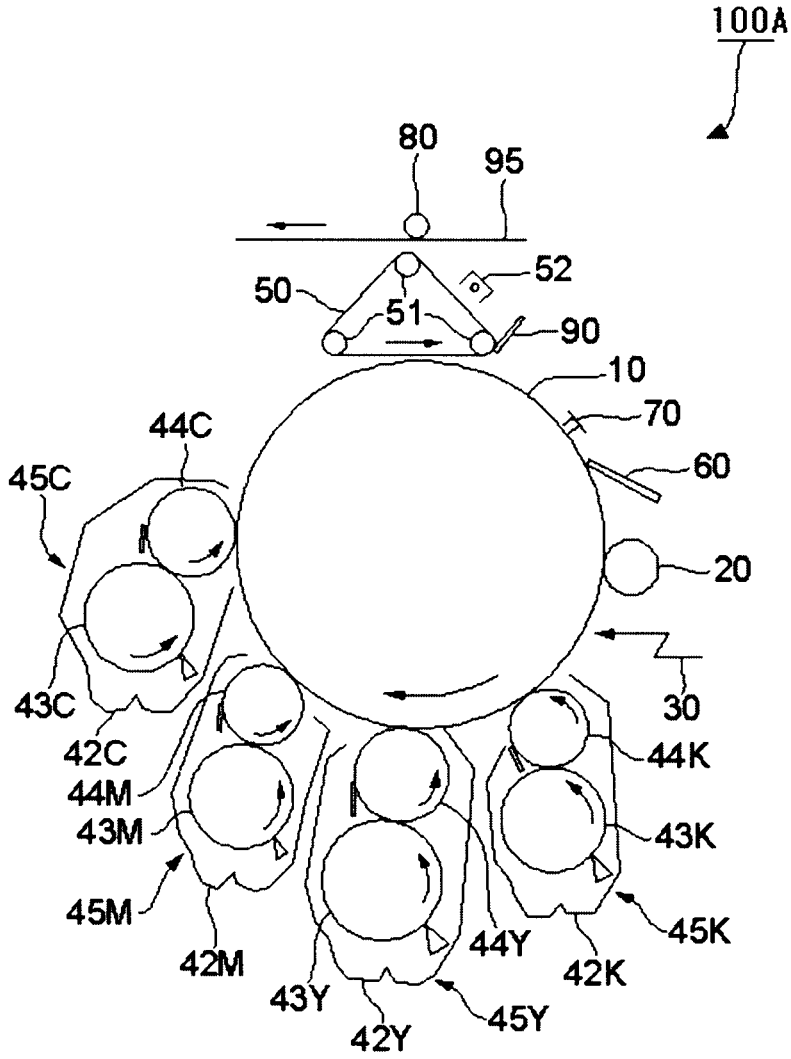
FIG. 1 shows an exemplary image forming apparatus used in an image forming method of the present invention.

The toner of the present invention contains at least a binder resin, a colorant, and a releasing agent, and further contains an active hydrogen group-containing compound, a pigment dispersant, and if necessary contains other components.

Colorant

The colorant contains at least C. I. PIGMENT YELLOW 185 and C. I. PIGMENT YELLOW 139, which are isoindoline pigments as yellow pigments, and if necessary further contains other components.

C. I. PIGMENT YELLOW 185 exhibits bright yellow color, and has high color strength. Since C. I. PIGMENT YELLOW 185 is a hydrophobic pigment, there is no problem that C. I. PIGMENT YELLOW 185 is transferred to an aqueous phase by aqueous granulation. However, C. I. PIGMENT YELLOW 185 having an absorption at 500 nm to 600 nm in a spectrum, thus C. I. PIGMENT YELLOW 185 is a yellow pigment strongly tinged with blue and yellow color reproducibility is poor. For example, a* is largely shifted to a negative side on a*-b*coordinates in accordance with Japan Color which is printing color standards for offset printing. On the other hand, C. I. PIGMENT YELLOW 139 is a yellow pigment strongly tinged with red. As the colorant, by using a combination of C. I. PIGMENT YELLOW 185 and C. I. PIGMENT YELLOW 139, a hue can be corrected.

The mass ratio (C. I. PIGMENT YELLOW 185/C. I. PIGMENT YELLOW 139) of C. I. PIGMENT YELLOW 185 to C. I. PIGMENT YELLOW 139 is not particularly limited and may be appropriately selected depending on the intended purpose, as long as it is 95/5 to 50/50. This range includes all specific values and subranges therebetween, such as 90/10, 80/20, 75/25, 70/30, 60/40 and 55/45. It is preferably 90/10 to 60/40, more preferably 85/15 to 70/30.

When the proportion of C. I. PIGMENT YELLOW 139 is less than 5, the red tinge is not sufficiently corrected, and a color difference becomes large from the Japan Color. When the proportion of C. I. PIGMENT YELLOW 139 is more than 50, chroma decreases due to a reflection component on the short wavelength side. The mass ratio in the particularly preferable range is advantageous in that a yellow toner having high chroma, a small color difference from the Japan Color, and high coloring performance can be obtained.

The amount of the colorant is not particularly limited and may be appropriately selected depending on the intended purpose. It is preferably 3 parts by mass to 15 parts by mass, more preferably 5 parts by mass to 10 parts by mass, relative to 100 parts by mass of the binder resin. These ranges include all specific values and subranges therebetween, including 4, 5, 8, 10, 12 and 14 parts by mass, relative to 100 parts by mass of the binder resin.

When the amount of the colorant is less than 3 parts by mass, a coloring properties of may not be sufficiently obtained, and the toner having poor coloring performance, and low chroma. When the amount of the colorant is more than 15 parts by mass, due to the absorption in a reflection range, a color difference from the Japan Color increases, and the absolute amount of the colorant increases, possibly causing decrease in charging ability of the toner, and increase in background smear in a long-term running at high temperature and high humidity. The amount of the colorant in the more preferable range is advantageous in that a yellow toner having a high chroma, small color difference from the Japan Color, and a high coloring performance can be obtained.

The colorant contains a mixed crystal of C. I. PIGMENT YELLOW 185 and C. I. PIGMENT YELLOW 139.

Since C. I. PIGMENT YELLOW 185 and C. I. PIGMENT YELLOW 139 are pigments having isoindoline skeletons, it is possible to form the mixed crystal by mixing and heating them.

By incorporating the mixed crystal of C. I. PIGMENT YELLOW 185 and C. I. PIGMENT YELLOW 139 in the colorant, a yellow toner having high chroma, a small color difference from the Japan Color, and a high coloring performance, and causing less background smear in long-term running at high temperature and high humidity.

The mixture of C. I. PIGMENT YELLOW 185 and C. I. PIGMENT YELLOW 139 forms the mixed crystal, so that a new crystalline peak obtained by X-ray diffraction analysis is determined, wherein the peak is not observed by the X-ray diffraction analysis of C. I. PIGMENT YELLOW 185 and C. I. PIGMENT YELLOW 139. Thus, whether or not the mixture of C. I. PIGMENT YELLOW 185 and C. I. PIGMENT YELLOW 139 contains the mixed crystal can be confirmed by performing X-ray diffraction analysis for determining the crystalline peaks.

A method for producing the mixed crystal of C. I. PIGMENT YELLOW 185 and C. I. PIGMENT YELLOW 139 is not particularly limited and may be appropriately selected depending on the intended purpose. An exemplary method is as follows: C. I. PIGMENT YELLOW 185 and C. I. PIGMENT YELLOW 139 are added to a solvent such as diacetone alcohol, and mixed and milled with a disperser, such as a bead mill, at 25° C. to 50° C. for 1 hour to 10 hours, followed by adding a sodium hydroxide solution to the resultant mixture, and further diluting the mixture with an acid, such as hydrochloric acid.

Before an oil phase is prepared, the colorant is preferably previously dispersed in the unmodified polyester resin, and the colorant is more preferably previously dispersed in the unmodified polyester resin by melting and kneading the colorant and the unmodified polyester resin.

Namely, in the preparation of the toner, a masterbatch in which the colorant is previously dispersed in the unmodified polyester resin is preferably used. Such masterbatch is used to ease an impact upon dispersing the colorant in the oil phase, so as to prevent aggregation of the colorant, and the dispersibility of the colorant is improved, thereby obtaining a yellow toner having an excellent hue and coloring performance, and causing less background smear in long-term running at high temperature and high humidity.

The preparation of the masterbatch, in which the colorant is previously dispersed in the unmodified polyester resin, is preferably performed by melting and kneading the colorant and the unmodified polyester resin. The masterbatch prepared by the melting and kneading is effectively dispersed by further adding a pigment dispersant in the unmodified polyester resin. The colorant does not reaggregate as in the dispersion of a solvent, thereby obtaining stable dispersibility of the colorant.

In the preparation of the masterbatch in which the colorant is previously dispersed in the unmodified polyester resin, a pigment press cake after washed is preferably used as the colorant. The pigment press cake contains water between pigment particles, and the water is replaced with the unmodified polyester resin during the melting and kneading. As a result, the pigment particles are not aggregated, and a toner having excellent pigment dispersibility can be obtained.

A melt-kneader for the melting and kneading is not particularly limited and may be appropriately selected depending on the intended purpose. Examples thereof include uniaxial extrusion kneaders, biaxial extrusion kneaders, two-roll kneaders, and three-toll kneaders.

Of these, open melt-kneaders, such as an open two-roll continuous kneader is preferable, in terms of improvement of dispersibility.

Since the open melt-kneaders can release heat generated at the time of shearing, kneading can be performed at a relatively low temperature. Since the kneading at low temperature enables to apply high shearing force to a toner material, a toner having an improved dispersibility of the colorant (pigment) can be obtained.

In the melt-kneader, the roll clearance at the kneaded product-discharging side is made wider than the roll clearance at the toner material-charging side, whereby the kneading force of the open-roll kneader, which otherwise applies high shearing force over the entire kneaded product, is converged at the toner material-charging side (first half of the material) and the latter half of the material is kneaded primarily by means of melting. In this way generation of heat associated with kneading can be suppressed, providing higher kneading effects. The adjacently-arranged two rolls consist of a heating roll through which a heating medium is provided and a cooling roll through which a cooling medium is provided. As a result, the adjacently-arranged two rolls can apply stronger shearing force, thereby improving the dispersibility of the releasing agent or the colorant (pigment), described below.

Pigment Dispersant

The pigment dispersant is not particularly limited and may be appropriately selected depending on the intended purpose. Examples thereof include carnauba waxes and fatty acid esters. Examples of the fatty acid esters include lauric acid esters, palmitic acid esters, stearic acid esters, linoleic acid esters, and montan acid esters. Of these, fatty acid esters are preferable, stearic acid esters and montan acid esters are more preferable, montan acid esters are particularly preferable. The fatty acid esters are easily dispersed in a toner, because an ester part is highly compatible with a resin for the toner. Moreover, since the fatty acid portion is highly compatible with a pigment surface, the fatty acid esters are excellent in dispersibility. Consequently, the fatty acid esters are preferable from the stand point of obtaining a toner having a high chroma, a small color difference from the Japan Color, and a high coloring performance, and causing less background smear at high temperature and high humidity. In the particularly preferable embodiment, the above-described effects are remarkable.

By preparing the masterbatch using the pigment dispersant, the dispersibility of the colorant in the unmodified polyester resin is improved, thereby obtaining a yellow toner having a excellent hue and coloring performance, and causing less background smear in long-term running at high temperature and high humidity.

The acid value of the pigment dispersant is not particularly limited and may be appropriately selected depending on the intended purpose. It is preferably 3 KOHmg/g to 20 KOHmg/g. When the acid value of the pigment dispersant is less than 3 KOHmg/g, the colorant may not be sufficiently dispersed. When the acid value of the pigment dispersant is more than 20 KOHmg/g, the toner is susceptible to the influence of an external environment. For example, charging ability at high temperature and high humidity may decrease, possibly causing background smear, toner scattering, and the like. On the other hand, the acid value of the pigment dispersant is within the above-described preferable range, the dispersibility of a colorant is improved, thereby obtaining a toner having excellent in long-term running at high temperature and high humidity.

The melting point of the pigment dispersant is not particularly limited and may be appropriately selected depending on the intended purpose. The melting point of the pigment dispersant is preferably lower than the softening point of the unmodified polyester resin, more preferably 70° C. to 110° C. This range includes all specific values and subranges therebetween, including 80° C., 90° C. and 100° C.

When the melting point of the pigment dispersant is higher than the softening point of the unmodified polyester resin, the pigment dispersant may not effectively adsorb to a colorant (pigment) surface during melting and kneading the pigment dispersant. On the other hand, when the melting point of the pigment dispersant is lower than the softening point of the unmodified polyester resin, the pigment dispersant is melted during the melting and kneading, the pigment dispersant adsorbs to particle surfaces in a state that the pigment dispersant is mixed with the colorant, thereby obtaining remarkable effects on the dispersibility of the colorant (pigment).

When the melting point of the pigment dispersant is lower than 70° C., storage stability at high temperature and high humidity may be adversely affected, possibly causing solidifying of the toner. When the melting point of the pigment dispersant is higher than 110° C., it is necessary to increase the temperature for melting the pigment dispersant during the melting and kneading, causing decrease in the viscosity of the unmodified polyester resin, possibly filing to apply a high shearing force.

The amount of the pigment dispersant is not particularly limited and may be appropriately selected depending on the intended purpose. It is preferably 1% by mass to 20% by mass relative to the masterbatch. This range includes all specific values and subranges therebetween, including 2, 5, 8, 10, 12, 15 and 18% by mass relative to the masterbatch. When the amount is less than 1% by mass, dispersibility may decrease, possibly causing decrease in chroma and the coloring performance. When the amount is more than 20% by mass, background smear at high temperature and high humidity may frequently occur.

Binder Resin

The binder resin is not particularly limited and may be appropriately selected depending on the intended purpose. Examples thereof include an unmodified polyester resin, which is obtained by dehydration condensation of a polyhydric alcohol component and a polyacid component; a polymer having a site reactive with an active hydrogen group-containing compound; and mixtures thereof. In the case where a toner is produced by a dissolution suspension method, examples of the binder resin include styrene resins, and acrylic resins.

Unmodified Polyester Resin

The unmodified polyester resin is not particularly limited and may be appropriately selected depending on the intended purpose. It is preferably a polyester resin obtained through polymerization using a propylene oxide adduct of a bisphenol in an amount of 50% by mole or higher relative to the total amount of the polyhydric alcohol components, more preferably a polyester resin obtained through polymerization using a propylene oxide adduct of a bisphenol in an amount of 70% by mole or higher relative to the total amount of the polyhydric alcohol components, and particularly preferably a polyester resin obtained through polymerization using a propylene oxide adduct of a bisphenol in an amount of 80% by mole or higher relative to the total amount of the polyhydric alcohol components, in terms of dispersibility.

Polyhydric Alcohol Component

The polyhydric alcohol component is not particularly limited and may be appropriately selected depending on a glass transition point, molecular weight, and softening point of a resin to be formed (for example, polyester resins). Examples thereof include diols and trihydric or higher alcohols.

The diols are not particularly limited and may be appropriately selected depending on the intended purpose. Examples of the diols include alkylene glycols such as ethylene glycol, 1,2-propylene glycol, 1,3-propylene glycol, 1,4-butanediol, and 1,6-hexanediol; oxyalkylene group-containing diols such as diethylene glycol, triethylene glycol, dipropylene glycol, polyethylene glycol, polypropylene glycol, and polytetramethylene glycol; alicyclic diols such as 1,4-cyclohexane dimethanol and hydrogenated bisphenol A; alkylene oxide adducts of the alicyclic diols, such as those obtained by adding an alkylene oxide such as ethylene oxide, propylene oxide, butylene oxide or the like to the alicyclic diols; bisphenols such as bisphenol A, bisphenol F, and bisphenol S; and alkylene oxide adducts of bisphenols, such as those obtained by adding an alkylene oxide such as ethylene oxide, butylene oxide or the like to the bisphenols. The number of the carbon atoms of the alkylene glycols is preferably 2 to 12.

Of these, alkylene glycols having 2 to 12 carbon atoms and alkylene oxide adducts of bisphenols are preferable, and alkylene oxide adducts of bisphenols are more preferable.

The trihydric or higher alcohols are not particularly limited and may be appropriately selected depending on the intended purpose. Examples thereof include trihydric or higher aliphatic alcohols, and trihydric or higher polyphenols, and alkylene oxide adducts of the trihydric or higher polyphenols.

The trihydric or higher aliphatic alcohols are not particularly limited and may be appropriately selected depending on the intended purpose. Examples thereof include glycerin, trimethylolethane, trimethylolpropane, pentaerythritol and sorbitol.

The trihydric or higher polyphenols are not particularly limited and may be appropriately selected depending on the intended purpose. Examples thereof include trisphenol PA, phenol novolac, and cresol novolac.

The alkylene oxide adducts of trihydric or higher polyphenols are not particularly limited and may be appropriately selected depending on the intended purpose. Specific examples thereof include those obtained by adding an alkylene oxide such as ethylene oxide, propylene oxide, or butylene oxide to trihydric or higher polyphenols.

Polyhydric Acid Component

The polyhydric acid components are not particularly limited and may be appropriately selected depending on the intended purpose. Examples thereof include polycarboxylic acids.

The polycarboxylic acids are not particularly limited and may be appropriately selected depending on the intended purpose. Examples thereof include dicarboxylic acids, tri- or higher carboxylic acids, and mixtures thereof. These may be used alone or in combination.

Of these, dicarboxylic acids and the mixtures of dicarboxylic acids and a small amount of tri- or higher carboxylic acids are preferable.

The dicarboxylic acids are not particularly limited and may be appropriately selected depending on the intended purpose. Examples thereof include dialkanoic acids, dialkenoic acids, and aromatic dicarboxylic acids.

The dialkanoic acids are not particularly limited and may be appropriately selected depending on the intended purpose. Examples thereof include succinic acid, adipic acid, and sebacic acid.

The dialkenoic acids are not particularly limited and may be appropriately selected depending on the intended purpose. Dialkenoic acids having 4 to 20 carbon atoms are preferable. Examples of the dialkenoic acids having 4 to 20 carbon atoms are not particularly limited and may be appropriately selected depending on the intended purpose. Examples thereof include maleic acid, and fumaric acid.

The aromatic dicarboxylic acids are not particularly limited and may be appropriately selected depending on the intended purpose. Aromatic dicarboxylic acids having 8 to 20 carbon atoms are preferable. The aromatic dicarboxylic acids having 8 to 20 carbon atoms are not particularly limited and may be appropriately selected depending on the intended purpose. Examples thereof include phthalic acid, isophthalic acid, terephthalic acid, and naphthalen dicarboxylic acid.

The tri- or higher carboxylic acids are not particularly limited and may be appropriately selected depending on the intended purpose. Examples thereof include tri- or higher aromatic carboxylic acids.

The tri- or higher aromatic carboxylic acids are not particularly limited and may be appropriately selected depending on the intended purpose. Aromatic carboxylic acids having 9 to 20 carbon atoms are preferable. The aromatic carboxylic acids having 9 to 20 carbon atoms are not particularly limited and may be appropriately selected depending on the intended purpose. Examples thereof include trimellitic acid, and pyromellitic acid.

The polycarboxylic acids are not particularly limited and may be appropriately selected depending on the intended purpose. Examples thereof include acid anhydrides of any of dicarboxylic acids, tri- or higher carboxylic acids, and mixtures of dicarboxylic acids and tri- or higher carboxylic acids; and lower alkyl esters.

The lower alkyl esters are not particularly limited and may be appropriately selected depending on the intended purpose. Examples thereof include methyl ester, ethyl ester, and isopropyl ester.

When the dicarboxylic acid and the tri- or higher carboxylic acid are mixed, the amount of the tri- or higher carboxylic acid relative to the dicarboxylic acid is not particularly limited and may be appropriately selected depending on the intended purpose. It is preferably 0.01% by mass to 10% by mass, more preferably 0.01% by mass to 1% by mass.

Upon polycondensation of polyol with polycarboxylic acid, the equivalent ratio [OH]/[COOH] of hydroxyl group [OH] content in polyol to carboxyl group [COOH] content in polycarboxylic acid is not particularly limited and may be appropriately selected depending on the intended purpose. It is preferably 1/1 to 2/1, more preferably 1/1 to 1.5/1, and particularly preferably 1.02/1 to 1.3/1.

The hydroxyl value and acid value of the unmodified polyester resin can be arbitrarily adjusted by adding trihydric or higher alcohols, or tri- or higher acids.

The acid value of the unmodified polyester resin is not particularly limited and may be appropriately selected depending on the intended purpose. It is preferably 5 KOHmg/g to 40 KOHmg/g. This range includes all specific values and subranges therebetween, such as 10, 12, 15, 20, 25, 30 and 35 KOHmg/g. When the acid value of the unmodified polyester resin is less than 5 KOHmg/g, it may be difficult to disperse a colorant. When the acid value of the unmodified polyester resin is more than 40 KOHmg/g, the unmodified polyester resin is susceptible to the influence of an external environment. For example, charging ability may decrease at high temperature and high humidity and background smear and a toner scattering may occur.

When the acid value of the unmodified polyester resin is within the above-described preferable range, the dispersibility of the colorant is improved, thereby obtaining a toner having excellent coloring, storage stability at high temperature and high humidity, and charging ability.

The weight average molecular weight of the unmodified polyester resin is not particularly limited and may be appropriately selected depending on the intended purpose. It is preferably 1,000 to 30,000, more preferably 1,500 to 15,000. These ranges include all specific values and subranges therebetween, such as 2,000, 5,000, 10,000, 15,000, 20,000 and 25,000. When the weight average molecular weight is lower than 1,000, the formed toner may have degraded heat-resistant storage stability. When the weight average molecular weight is higher than 30,000, the formed toner may have degraded low temperature fixing ability.

The glass transition temperature of the unmodified polyester resin is not particularly limited and may be appropriately selected depending on the intended purpose. It is preferably 30° C. to 70° C., more preferably 35° C. to 60° C., particularly preferably 35° C. to 55° C. When the glass transition temperature is lower than 30° C., the formed toner may have degraded heat-resistant storage stability. When the glass transition temperature is higher than 70° C., the formed toner may have insufficient low temperature fixing ability.

The softening point of the unmodified polyester resin is not particularly limited and may be appropriately selected depending on the intended purpose. The softening point is preferably 80° C. to 130° C., more preferably 85° C. to 120° C., particularly preferably 90° C. to 110° C.

When the softening point is lower than 80° C., the toner may be solidified or aggregate by storing the toner at high temperature. When the softening point is higher than 130° C., the toner may not spread on paper, causing poor glossiness and poor color reproducibility.

Polymer Having a Site Reactive with Active Hydrogen Group-Containing Compound

The polymer having a site reactive with an active hydrogen group-containing compound (hereinafter also referred to as "prepolymer") is not particularly limited and may be appropriately selected depending on the intended purpose. Examples thereof include polyol resins, polyacrylic resins, polyester resins, epoxy resins, and derivatives thereof. These may be used alone or in combination.

Of these, polyester resins are preferable in terms of their high flowability and transparency when melted.

Examples of the site reactive with the active hydrogen group-containing compound include an isocyanate group, an epoxy group, a carboxyl group, and a functional group having the formula —COCl—. The prepolymer may contain one or more of these groups.

Of these, the isocyanate group is preferable.

The prepolymer is not particularly limited and may be appropriately selected depending on the intended purpose. As the prepolymer, it is preferable to use a polyester resin having an isocyanate group or the like, which can produce a urea bond, since the molecular weights of polymer components can be readily adjusted and oil-less low-temperature fixing ability can be ensured in dry toner, particularly since it is possible to ensure excellent releasing ability and fixing ability even when there is no mechanism for applying a releasing oil to the heat medium for toner fixation.

Active Hydrogen Group-Containing Compound

The active hydrogen group-containing compound functions as an elongation agent or crosslinking agent when a polymer having a site reactive with an active hydrogen group undergoes an elongation or crosslinking reaction in an aqueous medium.

The active hydrogen group is not particularly limited and may be appropriately selected depending on the intended purpose. Examples of the active hydrogen group include hydroxyl groups (e.g., an alcoholic hydroxyl group and phenolic hydroxyl group), amino groups, carboxyl groups, and mercapto groups. These may be used alone or in combination.

The active hydrogen group-containing compound is not particularly limited and may be appropriately selected depending on the intended purpose. For example, in the case where the polymer having a site reactive with an active hydrogen group is an isocyanate group-containing polyester prepolymer, amines are preferable since the molecular weight can be increased by the elongation reaction or crosslinking reaction with the polyester prepolymer.

The amines are not particularly limited and may be appropriately selected depending on the intended purpose. Examples thereof include diamines, tri- or higher amines, amino alcohols, amino mercaptans, amino acids, and the above amines in which amino groups are blocked. These may be used alone or in combination.

Of these, diamines, and mixtures of diamines with a small amount of tri- or higher amines are preferable.

The diamines are not particularly limited and may be appropriately selected depending on the intended purpose. Examples thereof include aromatic diamines, alicyclic diamines and aliphatic diamines. The aromatic diamines are not particularly limited and may be appropriately selected depending on the intended purpose. Examples thereof include phenylene diamine, diethyltoluene diamine and 4,4'-diaminodiphenylmethane. The alicyclic diamines are not particularly limited and may be appropriately selected depending on the intended purpose. Examples thereof include 4,4'-diamino-3,3'-dimethyldicyclohexylmethane, diaminocyclohexane and isophorone diamine. The aliphatic diamines are not particularly limited and may be appropriately selected depending on the intended purpose. Examples thereof include ethylene diamine, tetramethylene diamine and hexamethylene diamine.

The tri- or higher amines are not particularly limited and may be appropriately selected depending on the intended purpose. Examples thereof include diethylene triamine and triethylene tetramine.

The amino alcohols are not particularly limited and may be appropriately selected depending on the intended purpose. Examples thereof include ethanolamine and hydroxyethylaniline.

The amino mercaptans are not particularly limited and may be appropriately selected depending on the intended purpose. Examples thereof include aminoethylmercaptan and aminopropylmercaptan.

The amino acids are not particularly limited and may be appropriately selected depending on the intended purpose. Examples thereof include amino propionic acid and amino capric acid.

The above amines with blocked amino groups are not particularly limited and may be appropriately selected depending on the intended purpose. Examples thereof include ketimine compounds and oxazoline compounds, which are obtained by blocking the amino groups of the above amines with a ketone such as acetone, methyl ethyl ketone or methyl isobutyl ketone.

Isocyanate Group-Containing Polyester Resin

The isocyanate group-containing polyester resin (hereinafter also referred to as "isocyanate group-containing polyester prepolymer") is not particularly limited and may be appropriately selected depending on the intended purpose. Examples thereof include reaction products of polyisocyanate and active hydrogen group-containing polyester resins obtained by polycondensation of polyols with polycarboxylic acids.

Polyols

The polyols are not particularly limited and may be appropriately selected depending on the intended purpose. Examples thereof include diols, trihydric or higher alcohols, and mixtures of diols and trihydric or higher alcohols. These may be used alone or in combination.

Of these, preferable are diols and mixtures of diols and a small amount of trihydric or higher alcohols.

The diols are not particularly limited and may be appropriately selected depending on the intended purpose. Examples of the diols include alkylene glycols such as ethylene glycol, 1,2-propylene glycol, 1,3-propylene glycol, 1,4-butanediol, and 1,6-hexanediol; oxyalkylene group-containing diols such as diethylene glycol, triethylene glycol, dipropylene glycol, polyethylene glycol, polypropylene glycol, and polytetramethylene glycol; alicyclic diols such as 1,4-cyclohexane dimethanol and hydrogenated bisphenol A; alkylene oxide adducts of the alicyclic diols, such as those obtained by adding an alkylene oxide such as ethylene oxide, propylene oxide, butylene oxide or the like to the alicyclic diols; bisphenols such as bisphenol A, bisphenol F, and bisphenol S; and alkylene oxide adducts of bisphenols, such as those obtained by adding an alkylene oxide such as ethylene oxide, propylene oxide, butylene oxide or the like to the bisphenols. The number of the carbon atoms of the alkylene glycols is not particularly limited and may be appropriately selected depending on the intended purpose, and it is preferably 2 to 12.

Of these, preferable are alkylene glycols having 2 to 12 carbon atoms and alkylene oxide adducts of bisphenols, with alkylene oxide adducts of bisphenols and mixtures of alkylene oxide adducts of bisphenols and alkylene glycols having 2 to 12 carbon atoms being particularly preferable.

The trihydric or higher alcohols are not particularly limited and may be appropriately selected depending on the intended purpose. Examples thereof include trihydric or higher aliphatic alcohols, and trihydric or higher polyphenols, and alkylene oxide adducts of the trihydric or higher polyphenols.

The trihydric or higher aliphatic alcohols are not particularly limited and may be appropriately selected depending on the intended purpose. Examples thereof include glycerin, trimethylolethane, trimethylolpropane, pentaerythritol and sorbitol.

The trihydric or higher polyphenols are not particularly limited and may be appropriately selected depending on the intended purpose. Examples thereof include trisphenol PA, phenol novolac, and cresol novolac.

The alkylene oxide adducts of trihydric or higher polyphenols are not particularly limited and may be appropriately selected depending on the intended purpose. Examples thereof include those obtained by adding an alkylene oxide such as ethylene oxide, propylene oxide, or butylene oxide to trihydric or higher polyphenols.

When the diol and trihydric or higher alcohol are mixed for use, the amount of trihydric or higher alcohol relative to the diol is not particularly limited and may be appropriately selected depending on the intended purpose. It is preferably 0.01% by mass to 10% by mass, more preferably 0.01% by mass to 1% by mass.

Polycarboxylic Acids

The polycarboxylic acids are not particularly limited and may be appropriately selected depending on the intended purpose. Examples thereof include dicarboxylic acids, tri- or higher carboxylic acids, and mixtures thereof. These may be used alone or in combination.

Of these, dicarboxylic acids and the mixtures of dicarboxylic acids and a small amount of tri- or higher carboxylic acids are preferable.

The dicarboxylic acids are not particularly limited and may be appropriately selected depending on the intended purpose. Examples thereof include dialkanoic acids, dialkenoic acids, and aromatic dicarboxylic acids.

The dialkanoic acids are not particularly limited and may be appropriately selected depending on the intended purpose. Examples thereof include succinic acid, adipic acid, and sebacic acid.

The dialkenoic acids are not particularly limited and may be appropriately selected depending on the intended purpose. Dialkenoic acids having 4 to 20 carbon atoms are preferable. Examples of the dialkenoic acids having 4 to 20 carbon atoms are not particularly limited and may be appropriately selected depending on the intended purpose. Examples thereof include maleic acid, and fumaric acid.

The aromatic dicarboxylic acids are not particularly limited and may be appropriately selected depending on the intended purpose. Aromatic dicarboxylic acids having 8 to 20 carbon atoms are preferable. The aromatic dicarboxylic acids having 8 to 20 carbon atoms are not particularly limited and may be appropriately selected depending on the intended purpose. Examples thereof include phthalic acid, isophthalic acid, terephthalic acid, and naphthalen dicarboxylic acid.

The tri- or higher carboxylic acids are not particularly limited and may be appropriately selected depending on the intended purpose. Examples thereof include tri- or higher aromatic carboxylic acids.

The tri- or higher aromatic carboxylic acids are not particularly limited and may be appropriately selected depending on the intended purpose. Aromatic carboxylic acids having 9 to 20 carbon atoms are preferable. The aromatic carboxylic acids having 9 to 20 carbon atoms are not particularly limited and may be appropriately selected depending on the intended purpose. Examples thereof include trimellitic acid, and pyromellitic acid.

The polycarboxylic acids are not particularly limited and may be appropriately selected depending on the intended purpose. Examples thereof include acid anhydrides of any of dicarboxylic acids, tri- or higher carboxylic acids, and mixtures of dicarboxylic acids and tri- or higher carboxylic acids; and lower alkyl esters.

The lower alkyl esters are not particularly limited and may be appropriately selected depending on the intended purpose. Examples thereof include methyl ester, ethyl ester, and isopropyl ester.

When the dicarboxylic acid and the tri- or higher carboxylic acid are mixed, the amount of the tri- or higher carboxylic acid relative to the dicarboxylic acid is not particularly limited and may be appropriately selected depending on the intended purpose. It is preferably 0.01% by mass to 10% by mass, more preferably 0.01% by mass to 1% by mass.

Upon polycondensation of the polyol with the polycarboxylic acid, the equivalent ratio [OH]/[COOH] of hydroxyl group [OH] content in polyol to carboxyl group [COOH] content in polycarboxylic acid is not particularly limited and may be appropriately selected depending on the intended purpose. It is preferably 1/1 to 2/1, more preferably 1/1 to 1.5/1, and particularly preferably 1.02/1 to 1.3/1.

The amount of the polyol-derived component in the isocyanate group-containing polyester prepolymer is not particularly limited and may be appropriately selected depending on the intended purpose. It is preferably 0.5% by mass to 40% by mass, more preferably 1% by mass to 30% by mass, and particularly preferably 2% mass to 20% by mass.

When the amount is less than 0.5% by mass, the hot offset resistance may be poor, possibly causing difficulty in satisfying both heat-resistant storage stability and low temperature fixing ability. When the amount is greater than 40% by mass, the low temperature fixing ability may be poor.

Polyisocyanates

The polyisocyanates are not particularly limited and may be appropriately selected depending on the intended purpose. Examples thereof include aliphatic diisocyanates, alicyclic diisocyanates, aromatic diisocyanates, aromatic aliphatic diisocyanates, isocyanurates, and blocked products of the polyisocyanates with phenol derivatives, oximes, caprolactams, etc.

The aliphatic diisocyanates are not particularly limited and may be appropriately selected depending on the intended purpose. Examples thereof include tetramethylene diisocyanate, hexamethylene diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, and tetramethyl hexane diisocyanate.

The alicyclic diisocyanates are not particularly limited and may be appropriately selected depending on the intended purpose; examples thereof include isophorone diisocyanate, and cyclohexylmethane diisocyanate.

The aromatic diisocyanates are not particularly limited and may be appropriately selected depending on the intended purpose. Examples thereof include tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, and diphenylether-4,4'-diisocyanate.

The aromatic aliphatic diisocyanates are not particularly limited and may be appropriately selected depending on the intended purpose. Examples thereof include $\alpha,\alpha,\alpha',\alpha'$-tetramethyl xylylene diisocyanate.

The isocyanurates are not particularly limited and may be appropriately selected depending on the intended purpose.

Examples thereof include tris-isocyanatoalkyl-isocyanurate, and tris(isocyanatocycloalkyl)isocyanurate. These may be used alone or in combination.

In reaction between the polyisocyanate and the hydroxyl group-containing polyester resin, the equivalent ratio of the ([NCO]/[OH]) of an isocyanate group [NCO] in the polyisocyanate to a hydroxyl group [OH] in the hydroxyl group-containing polyester resin is not particularly limited and may be appropriately selected depending on the intended purpose. It is preferably 1/1 to 5/1, more preferably 1.2/1 to 4/1, particularly preferably 1.5/1 to 3/1. When the equivalent ratio is less than 1/1, offset resistance may be poor. When the equivalent ratio is greater than 5/1, the low temperature fixing ability may be poor.

The amount of the polyisocyanate-derived component in the isocyanate group-containing polyester prepolymer is not particularly limited and may be appropriately selected depending on the intended purpose. It is preferably 0.5% by mass to 40% by mass, more preferably 1% by mass to 30% by mass, and particularly preferably 2% mass to 20% by mass. When the amount is less than 0.5% by mass, the hot offset resistance may be poor. When the amount is greater than 40% by mass, the low temperature fixing ability may be poor.

The average number of isocyanate groups per one molecule of the isocyanate group-containing polyester prepolymer is not particularly limited and may be appropriately selected depending on the intended purpose. It is preferably 1 or more, more preferably 1.2 to 5, and particularly preferably 1.5 to 4. When the average number is less than 1, the molecular weight of the urea-modified polyester resin decreases and thus the hot offset resistance may be poor.

The mass ratio (isocyanate group-containing polyester prepolymer/polyester resin) of the isocyanate group-containing polyester prepolymer to the polyester resin containing 50% by mole or more of the propylene oxide adducts of bisphenols in the polyhydric alcohol component, and having a certain hydroxyl value and acid value is not particularly limited and may be appropriately selected depending on the intended purpose. It is preferably 5/95 to 25/75, more preferably 10/90 to 25/75. When the mass ratio is less than 5/95, the hot offset resistance may decrease. When the mass ratio is more than 25/75, low temperature fixing ability and image glossiness may decrease.

Releasing Agent

The releasing agent is not particularly limited and may be appropriately selected depending on the intended purpose. Examples of the releasing agent include natural waxes and synthetic waxes.

The natural waxes are not particularly limited and may be appropriately selected depending on the intended purpose. Examples thereof include animal waxes (e.g., bees wax, spermaceti wax and shellac wax), vegetable waxes (e.g., carnauba wax, Japan wax, rice bran wax (rice wax) and candelilla wax), petroleum waxes (e.g., paraffin waxes, and microcrystalline waxes), mineral waxes (e.g., montan wax, and ozokelite).

The synthetic waxes are not particularly limited and may be appropriately selected depending on the intended purpose. Examples thereof include Fischer-Tropsch waxes, polyethylene waxes, oil-based synthetic waxes (e.g., ester waxes, ketone waxes and amide waxes) and hydrogenated waxes.

The type of the releasing agent is not particularly limited and may be appropriately selected depending on the intended purpose. In terms of releasability, it is preferably carboxylic acid-modified hydrocarbon wax, in which the hydrocarbon wax is obtained by separating and refining distillation of petroleum oil through reduced-pressure distillation.

Since the paraffin wax has low penetration, and low viscosity at relatively low temperature, and is modified, the acid value of the releasing agent can be relatively easily controlled.

The melting point of the releasing agent is not particularly limited and may be appropriately selected depending on the intended purpose. The melting point is preferably lower than the softening point of the unmodified polyester resin, from the standpoint of releasability, and more preferably 70° C. to 110° C.

The amount added of the releasing agent is not particularly limited and may be appropriately selected depending on the intended purpose. The amount of the releasing agent is preferably 1 part by mass to 20 parts by mass, more preferably 3 parts by mass to 10 parts by mass, relative to 100 parts by mass of the binder resin, from the standpoint of releasability, storage stability at high temperature and high humidity, and charging ability.

When the amount of the releasing agent is less than 1 part by mass relative to 100 parts by mass of the binder resin, the releasing ability may be small. When the amount is higher than 20 parts by mass, the formed toner may be susceptible to the influence of environment.

The acid value of the releasing agent is not particularly limited and may be appropriately selected depending on the intended purpose. It is preferably 3 KOHmg/g to 20 KOHmg/g.

The viscosity of the releasing agent is not particularly limited and may be appropriately selected depending on the intended purpose. The viscosity at 90° C. is preferably 5 cps to 50 cps from the standpoint of bleeding properties not to inhibit charging.

Other Components

As the other components, a charge control agent, an external additive, and the like may be used in the present invention.

Charge Control Agent

The charge control agent is not particularly limited and may be appropriately selected depending on the intended purpose. It is preferable to employ a colorless or white charge control agent as colored charge control agents change the color tone.

The colorless or white charge control agent is not particularly limited and may be appropriately selected depending on the intended purpose. Examples thereof include triphenylmethane dyes, molybdic acid chelate pigments, rhodamine dyes, alkoxy amines, quaternary ammonium salts such as fluorine-modified quaternary ammonium salts, alkylamides, phosphorus or compounds thereof, tungsten or compounds thereof, fluorine surfactants, metallic salts of salicylic acid, and metallic salts of salicylic acid derivatives. These may be used alone or in combination.

The charge control agent may be any of commercially available products.

The commercially available products are not particularly limited and may be appropriately selected depending on the intended purpose. Specific examples thereof include quaternary ammonium salt BONTRON P-51, oxynaphthoic acid metal complex BONTRON E-82, salicylic acid metal complex BONTRON E-84, and phenol condensate BONTRON E-89 (available from Orient Chemical Industries, Ltd.); quaternary ammonium salt molybdenum metal complexes TP-302 and TP-415 (available from Hodogaya Chemical Co. Ltd.); LRA-901 and boron complex LR-147 (available from Japan Carlit Co., Ltd.); and quinacridone, azo pigment and other high-molecular mass compounds having a sulfonic group, a carboxyl group, quaternary ammonium salt, or the like.

The amount of the charge control agent is not particularly limited and may be appropriately selected depending on the type of a binder resin, presence or absence of an additive, and a method of dispersing; however, it is preferably 0.1 parts by mass to 10 parts by mass, and more preferably 0.2 parts by mass to 5 parts by mass, relative to 100 parts by mass of the binder resin.

When amount of the charge control agent is less than 0.1 parts by mass, charge control ability may not be obtained. When the amount is greater than 10 parts by mass, the charge amount of toner becomes so high that the electrostatic attraction force that attracts toner particles to the developing roller increases, causing decrease in developer flowability or image density.

External Additives

The external additives are not particularly limited and may be appropriately selected depending on the intended purpose. Examples thereof include organic particles and inorganic particles.

The organic particles are not particularly limited and may be appropriately selected depending on the intended purpose. Examples thereof include PMMA.

The inorganic particles are not particularly limited and may be appropriately selected depending on the intended purpose. Examples thereof include particles made of silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, or silicon nitride. These may be used alone or in combination.

The primary particle diameter of the inorganic particles is not particularly limited and may be appropriately selected depending on the intended purpose. It is preferably 5 nm to 2 μm, more preferably 5 nm to 500 nm.

The specific surface area of the inorganic particles, as measured by a BET method, is not particularly limited and may be appropriately selected depending on the intended purpose. It is preferably 20 $m^2/g$ to 500 $m^2/g$.

The amount of the inorganic particles in the toner is not particularly limited and may be appropriately selected depending on the intended purpose. It is preferably 0.01% by mass to 5.0% by mass, more preferably 0.01% by mass to 5.0% by mass.

The inorganic particles are preferably subjected to surface treatment for use, from the standpoint of improvement of flowability and blocking properties, storage stability and water resistance.

Treating agents used for the surface treatment are not particularly limited and may be appropriately selected depending on the intended purpose. Examples thereof include silane coupling agents, silylating agents, fluorinated alkyl group-containing silane coupling agents, organic titanate-based coupling agents, aluminum-based coupling agents, silicone oils, and modified-silicone oils.

Oil Phase

The oil phase is not particularly limited and may be appropriately selected depending on the intended purpose. It preferably contains a toner material containing the binder resin, the colorant, and the releasing agent. The toner material is preferably dissolved or dispersed in a solvent.

The solvent is not particularly limited and may be appropriately selected depending on the intended purpose. The solvent preferably contains an organic solvent. The organic solvent is preferably removed during or after formation of the toner base particles.

The organic solvent is not particularly limited, and may be appropriately selected depending on the intended purpose. The organic solvent having a boiling point of lower than 150° C. is preferable in terms of easy removal.

The organic solvent having a boiling point of lower than 150° C. is not particularly limited and may be appropriately selected depending on the intended purpose. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination.

Of these, ethyl acetate, toluene, xylene, benzene, methylene chloride, 1,2-dichloroethane, chloroform, and carbon tetrachloride are preferable, and ethyl acetate is more preferable.

The amount of the organic solvent is not particularly limited and may be appropriately selected depending on the intended purpose. The amount of the organic solvent is preferably 40 parts by mass to 300 parts by mass, more preferably 60 parts by mass to 140 parts by mass, particularly preferably 80 parts by mass to 120 parts by mass, relative to 100 parts by mass of the toner material.

The toner material is not particularly limited and may be appropriately selected depending on the intended purpose, as long as it contains at least a binder resin, a colorant, and a releasing agent. If necessary, the toner material may further contain a charge control agent.

The mixing ratio (colorant/organic solvent) of the colorant to the organic solvent in the oil phase containing the toner material is not particularly limited and may be appropriately selected depending on the intended purpose. The mixing ratio (colorant/organic solvent) is 5/95 to 50/50 in terms of mass ratio.

The mixing ratio of the colorant to the organic solvent is less than 5/more than 95, the amount of the organic solvent increases during toner production, and the production efficiency of the toner decreases. When the mixing ratio of the colorant to the organic solvent is more than 50/less than 50, the colorant may be insufficiently dispersed.

When the toner material is emulsified or dispersed in the aqueous medium using the oil phase containing the toner material, the oil phase containing the toner material is preferably dispersed in the aqueous medium with stirring.

A disperser for dispersing is not particularly limited and may be appropriately selected depending on the intended purpose. Examples thereof include a low-speed shear disperser, high-speed shear disperser, friction disperser, high-pressure and jet disperser, and supersonic disperser.

Of these, the high-speed shear disperser is preferable, because it is capable of adjusting the particle diameter of the dispersion (oil droplet) to be a range of 2 μm to 20 μm.

When the high-speed shear disperser is used, conditions of rotational speed, dispersing time, dispersing temperature, etc., are not particularly limited and may be appropriately selected depending on the intended purpose.

The rotational speed is not particularly limited and may be appropriately selected depending on the intended purpose. It is preferably 1,000 rpm to 30,000 rpm, more preferably 5,000 rpm to 20,000 rpm.

The dispersing time is not particularly limited and may be appropriately selected depending on the intended purpose. It is preferably 0.1 minutes to 5 minutes in the case of batch method.

The dispersing temperature is not particularly limited and may be appropriately selected depending on the intended purpose. It is preferably 0° C. to 150° C., more preferably 40° C. to 98° C. under pressure. In general, dispersing can be more easily effected at a high temperature for dispersing.

Aqueous Medium

The aqueous medium is not particularly limited and may be appropriately selected depending on the intended purpose.

Examples thereof include water, water-miscible solvents and mixtures thereof. These may be used alone or in combination.

Of these, water is preferable.

The water-miscible solvents are not particularly limited and may be appropriately selected depending on the intended purpose. Examples thereof include alcohols, dimethylformamide, tetrahydrofuran, cellsolves and lower ketones. The alcohols are not particularly limited and may be appropriately selected depending on the intended purpose. Examples thereof include methanol, isopropanol and ethylene glycol. The lower ketones are not particularly limited and may be appropriately selected depending on the intended purpose. Examples thereof include acetone and methyl ethyl ketone.

Method for Producing Toner

As the method for producing a toner, known dissolution suspension methods are exemplified.

As another method for producing a toner, a method of producing toner base particles while producing an adhesive base material obtained by elongation and/or crosslinking reaction of the active hydrogen group-containing compound and the polymer having a site reactive with the active hydrogen group-containing compound is described below. In this method, synthesis of the polymer having a site reactive with an active hydrogen group, synthesis of the active hydrogen group-containing compound, preparation of an aqueous medium, preparation of an oil phase containing a toner material, emulsification or dispersing of the toner material, production of the adhesive base material, solvent removal, etc., are carried out.

Preparation of the Aqueous Medium can be Achieved by Dispersing resin particles into an aqueous medium. The amount of the resin particles to be added in the aqueous medium is not particularly limited and may be appropriately selected depending on the intended purpose. It is preferably 0.5% by mass to 10% by mass.

The oil phase containing the toner material can be prepared by dissolving or dispersing in an organic solvent a toner material containing an active hydrogen group-containing compound, a polymer having a site reactive with an active hydrogen group-containing compound, a colorant, a releasing agent, and an unmodified polyester resin, etc. In the toner material the components other than the binder resin and the colorant may be added in the aqueous medium upon dispersing of the resin particles in the aqueous medium, or may be added in the aqueous medium upon addition of the oil phase containing the toner material in the aqueous medium.

Emulsification or dispersing of the toner material can be achieved by dispersing the oil phase containing the toner material in the aqueous medium. By allowing the active hydrogen group-containing compound and the polymer having a site reactive with the active hydrogen group-containing compound to undergo elongation reaction and/or crosslinking reaction upon emulsification or dispersing of the toner material, an adhesive base material is produced.

The adhesive base material may be produced by emulsifying or dispersing in an aqueous medium an oil phase containing a polymer reactive with an active hydrogen group (e.g., isocyanate group-containing polyester prepolymer) together with an active hydrogen group-containing compound (e.g., amine) so that they undergo elongation reaction and/or crosslinking reaction in the aqueous medium, may be produced by emulsifying or dispersing an oil phase containing a toner material in an aqueous medium in which the active hydrogen group-containing compound has been previously added so that they undergo elongation reaction and/or crosslinking reaction in the aqueous medium, or may be produced by emulsifying or dispersing an oil phase containing a toner material in an aqueous medium and adding the active hydrogen group-containing compound so that they undergo elongation reaction and/or crosslinking reaction from particle interfaces in the aqueous medium. When effecting the elongation reaction and/or crosslinking reaction from particle interfaces, the urea-modified polyester resin is preferentially formed on the toner particle surfaces being produced; thus it is possible to form a concentration gradient of the urea-modified polyester resin in the toner particles.

The reaction conditions, such as reaction time, reaction temperature, etc. used for the production of the adhesive base material is not particularly limited and may be appropriately determined depending on the combinations of the polymer having a site reactive with an active hydrogen group and the active hydrogen group-containing compound.

The reaction time is not particularly limited and may be appropriately selected depending on the intended purpose. It is preferably from 10 minutes to 40 hours, more preferably from 2 hours to 24 hours.

The reaction temperature is not particularly limited and may be appropriately selected depending on the intended purpose. It is preferably 0° C. to 150° C., more preferably from 40° C. to 98° C.

A method of stably forming a dispersion liquid containing the polymer having a site reactive with the active hydrogen group-containing compound (e.g. isocyanate group-containing polyester prepolymer) in the aqueous medium is not particularly limited and may be appropriately selected depending on the intended purpose. For example, a method is exemplified, in which an oil phase prepared by dissolving or dispersing in a solvent a toner material containing the binder resin, the colorant, the releasing agent, and the charge control agent is added in an aqueous medium and dispersed by shear force.

A disperser for dispersing is not particularly limited and may be appropriately selected depending on the intended purpose. Examples thereof include a low-speed shear disperser, high-speed shear disperser, friction disperser, high-pressure and jet disperser, and supersonic disperser.

Of these, the high-speed shear disperser is preferable, because it is capable of adjusting the particle diameter of the dispersion (oil droplet) to be a range of 2 μm to 20 μm.

When the high-speed shear disperser is used, conditions of rotational speed, dispersing time, dispersing temperature, etc., can be determined depending on the intended purpose.

The rotational speed is not particularly limited and may be appropriately selected depending on the intended purpose. It is preferably 1,000 rpm to 30,000 rpm, more preferably 5,000 rpm to 20,000 rpm.

The dispersing time is not particularly limited and may be appropriately selected depending on the intended purpose. It is preferably 0.1 minutes to 5 minutes in the case of batch method.

The dispersing temperature is not particularly limited and may be appropriately selected depending on the intended purpose. It is preferably 0° C. to 150° C., more preferably 40° C. to 98° C. under pressure. In general, dispersing can be more easily effected at higher temperature.

The amount of the aqueous medium for emulsification or dispersing of the toner material is not particularly limited and may be appropriately selected depending on the intended purpose. It is preferably 50 parts by mass to 2,000 parts by mass, more preferably 100 parts by mass to 1,000 parts by mass relative to 100 parts by mass of the toner material.

When the amount of the aqueous medium is less than 50 parts by mass, the toner material is poorly dispersed and thus toner base particles each having a desired particle diameter cannot be obtained. When it is more than 2,000 parts by mass, production costs may be high.

Dispersant

When the oil phase containing the toner material is emulsified or dispersed, a dispersant is preferably used for the purpose of stabilizing the dispersion (e.g., oil droplets) to have a desired shape, and of obtaining a sharp particle size distribution.

The dispersant is not particularly limited and may be appropriately selected depending on the intended purpose. Examples thereof include surfactants, sparingly water soluble inorganic dispersants, and polymeric protective colloids. These dispersants may be used alone or in combination.

Of these, surfactants are preferable.

Surfactant

The surfactants are not particularly limited and may be appropriately selected depending on the intended purpose. Examples thereof include anionic surfactants, cationic surfactants, nonionic surfactants, and ampholytic surfactants.

The anionic surfactants are not particularly limited and may be appropriately selected depending on the intended purpose. Examples thereof include alkylbenzene sulfonates, α-olefin sulfonates, and phosphates.

Of these, those having fluoroalkyl groups are preferable.

The fluoroalkyl group-containing anionic surfactants are not particularly limited and may be appropriately selected depending on the intended purpose. Examples thereof include fluoroalkyl carboxylic acids having 2 to 10 carbon atoms or metal salts thereof, disodium perfluorooctanesulfonylglutamate, sodium-3-{omega-fluoroalkyl (C6-C11)oxy}-1-alkyl(C3-C4)sulfonate, sodium-3-{omega-fluoroalkanoyl (C6-C8)-N-ethylamino}-1-propanesulfonate, fluoroalkyl (C11-C20) carboxylic acids or metal salts thereof, perfluoroalkyl(C7-C13)carboxylic acids or metal salts thereof, perfluoroalkyl(C4-C12)sulfonic acids or metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycine, and monoperfluoroalkyl(C6-C16)ethylphosphoric acid esters.

The commercially available products of the fluoroalkyl group-containing surfactants are not particularly limited and may be appropriately selected depending on the intended purpose. Examples thereof include, but not limited to, SURFLON S-111, S-112 and S-113 (manufactured by Asahi Glass Co., Ltd.); FLUORAD FC-93, FC-95, FC-98 and FC-129 (manufactured by Sumitomo 3M Limited); UNIDYNE DS-101 and DS-102 (manufactured by Daikin Industries, Ltd.); MEGAFACE F-110, F-120, F-113, F-191, F-812 and F-833 (manufactured by Dainippon Ink and Chemicals, Incorporated); EETOP EF-102, 103, 104, 105, 112, 123A, 123B, 306A, 501, 201 and 204 (manufactured by Tohchem Products Co., Ltd.); and FTERGENT 100 and 150 (manufactured by NEOS COMPANY LIMITED).

The cationic surfactants are not particularly limited and may be appropriately selected depending on the intended purpose. Examples thereof include amine salts such as alkyl amine salts, amino alcohol fatty acid derivatives, polyamine fatty acid derivatives, and imidazoline; and quaternary ammonium salts such as alkyltrimethyl ammonium salts, dialkyldimethyl ammonium salts, alkyldimethyl benzyl ammonium salts, pyridinium salts, alkyl isoquinolinium salts, and benzethonium chloride.

Of these, preferable examples thereof include primary, secondary or tertiary fluoroalkyl group-containing aliphatic amine acids, aliphatic quaternary ammonium salts such as perfluoroalkyl(C6-C10)sulfoneamide propyl trimethyl ammonium salts, benzalkonium salts, benzetonium chloride, pyridinium salts, and imidazolinium salt.

The commercially available products of the cationic surfactants are not particularly limited and may be appropriately selected depending on the intended purpose. Examples thereof include, but not limited to, SURFLON S-121 (manufactured by Asahi Glass Co., Ltd.), FLUORAD FC-135 (manufactured by Sumitomo 3M Limited), UNIDYNE DS-202 (manufactured by Daikin Industries, Ltd.), MEGAFACE F-150 and F-824 (manufactured by Dainippon Ink and Chemicals, Incorporated), EFTOP EF-132 (manufactured by Tohchem Products Co., Ltd.), and FTERGENT F-300 (manufactured by NEOS COMPANY LIMITED).

The nonionic surfactants are not particularly limited and may be appropriately selected depending on the intended purpose. Examples thereof include fatty acid amide derivatives, and polyhydric alcohol derivatives.

The ampholytic surfactants are not particularly limited and may be appropriately selected depending on the intended purpose. Examples thereof include alanine, dodecyldi(aminoethyl)glycine, di(octylaminoethyl)glycine, and N-alkyl-N, N-dimethyl ammonium betaine.

Sparingly Water Soluble Inorganic Dispersant

The sparingly water soluble inorganic dispersants are not particularly limited and may be appropriately selected depending on the intended purpose. Examples thereof include tricalcium phosphate, calcium carbonate, titanium oxide, colloidal silica, and hydroxyl apatite.

Polymeric Protective Colloid

The polymeric protective colloids are not particularly limited and may be appropriately selected depending on the intended purpose. Examples thereof include homopolymers or copolymers prepared by polymerization of a carboxyl group-containing monomer, hydroxyl group-containing alkyl(meth)acrylate, vinyl ether, vinyl carboxylate, amide monomer, acid chloride monomer, or monomer containing a nitrogen atom or heterocyclic ring thereof; polyoxyethylene resin; and cellulose. The homopolymers or copolymers obtained by polymerization of any of the above monomers include those having vinyl alcohol-derived units.

The carboxyl group-containing monomer is not particularly limited and may be appropriately selected depending on the intended purpose. Examples thereof include acrylic acid, methacrylic acid, α-cyanoacrylic acid, α-cyanomethacrylic acid, itaconic acid, crotonic acid, fumaric acid, maleic acid, and maleic anhydride.

The hydroxyl group-containing (meth)acrylic monomer is not particularly limited and may be appropriately selected depending on the intended purpose. Examples thereof include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, and glycerin monomethacrylate.

The vinyl ether is not particularly limited and may be appropriately selected depending on the intended purpose. Examples thereof include vinyl methyl ether, vinyl ethyl ether, and vinyl propyl ether.

The vinyl carboxylate is not particularly limited and may be appropriately selected depending on the intended purpose. Examples thereof include vinyl acetate, vinyl propionate, and vinyl butyrate.

The amide monomer is not particularly limited and may be appropriately selected depending on the intended purpose.

Examples thereof include acrylamide, methacrylamide, diacetone acrylicamide, N-methylolacrylamide, and N-methylolmethacrylamide.

The acid chloride monomer is not particularly limited and may be appropriately selected depending on the intended purpose. Examples thereof include acrylic chloride, and methacrylic chloride.

The monomer having a nitrogen atom or heterocyclic ring thereof is not particularly limited and may be appropriately selected depending on the intended purpose. Examples thereof thereof include vinyl pyridine, vinyl pyrrolidone, vinyl imidazole, and ethyleneimine.

The polyoxyethylene resin is not particularly limited and may be appropriately selected depending on the intended purpose. Examples thereof include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene phenyl stearate, and polyoxyethylene phenyl pelargonate.

The cellulose is not particularly limited and may be appropriately selected depending on the intended purpose. Examples thereof include methyl cellulose, hydroxyethyl cellulose, and hydroxypropyl cellulose.

The dispersants other than those above-mentioned are not particularly limited and may be appropriately selected depending on the intended purpose. Examples thereof include compounds capable of being dissolved in acid or alkali, such as calcium phosphate. When calcium phosphate is employed, it can be removed by dissolving it in hydrochloric acid or the like and followed by washing with water, or by enzymatic decomposition.

Catalyst

A catalyst can be used for elongation reaction and/or crosslinking reaction for production of adhesive base material.

The catalyst is not particularly limited and may be appropriately selected depending on the intended purpose. Examples thereof include dibutyltin laurate, and dioctyltin laurate.

The method for removing the organic solvent from the obtained dispersion liquid (e.g., emulsified slurry) is not particularly limited and may be appropriately selected depending on the intended purpose. It is carried out, for example, by any of the following methods: a method in which the temperature of the whole reaction system is gradually increased for evaporation of the organic solvent in oil droplets; and a method in which the dispersion liquid is sprayed in a dry atmosphere for removal of the organic solvent from oil droplets.

Once the organic solvent has been removed, toner base particles are formed. The toner particles may be washed and dried, and if necessary, can be classified. The classification is, for example, carried out using a cyclone, decanter, or centrifugal separation in the solution for removal of fine particles. Alternatively, the classification is carried out after the toner particles have been dried.

The thus obtained toner base particles may be mixed with particles of such agents as a releasing agent, and/or charge control agent. At this time, mechanical impact may be applied to the toner particles so as to prevent the particles of the releasing agent, etc., from being come off from the toner base particle surface.

The method of application of mechanical impact is not particularly limited and may be appropriately selected depending on the intended purpose. Examples thereof include a method in which impact is applied to mixed particles by rotating a blade at high speeds, and a method in which impact is applied to mixed particles by putting the mixed particles into a high-speed air flow and accelerating the air speed such that the particles collide with one another or that the particles are crashed into a proper collision plate.

The device employed for this method is not particularly limited and may be appropriately selected depending on the intended purpose. Examples thereof include Angmill (manufactured by Hosokawa Micron Corporation), modified I-type mill (manufactured by Nippon Pneumatic Mfg. Co., Ltd.) to decrease pulverization air pressure, hybridization system (manufactured by Nara Machinery Co., Ltd.), kryptron system (manufactured by Kawasaki Heavy Industries, Ltd.), and automatic mortar.

Toner Properties

When the toner of the present invention contains the adhesive base material obtained by reaction of the active hydrogen group-containing compound and the polymer having a site reactive with the active hydrogen group-containing compound in the aqueous medium, the toner is superior in toner properties such as transferability and fixing ability to the toner without containing the adhesive base material. Therefore, the toner of the present invention can be used in various fields, and suitably used in image formation by electrophotography.

Volume-Average Particle Diameter of Toner

The volume-average particle diameter of the toner is not particularly limited and may be appropriately selected depending on the intended purpose. It is preferably 3 μm to 8 μm, more preferably 4 μm to 7 μm.

When the volume-average particle diameter is less than 3 μm, in the case of a two-component developer, toner fusion to a carrier surface occurs during long term stirring in a developing device, possibly causing decrease of the charging ability of the carrier, and in the case of a one-component developer, toner filming to a development roller or toner fusing to members (e.g., a blade to form a thin toner film) occurs. When the volume-average particle diameter is greater than 8 μm, it becomes difficult to provide a high-resolution, high-quality image, and variations in toner particle diameter may increase after toner consumption or toner supply in the developer.

The ratio of the volume-average particle diameter to the number-average particle diameter of the toner is not particularly limited and may be appropriately selected depending on the intended purpose. It is preferably 1.00 to 1.25, more preferably 1.05 to 1.25.

When this ratio falls within the above-preferable range in the case of the two-component developer, variations in toner particle diameter are small in the developer even after toner consumption and toner supply have been repeated for a long time, and in addition, even after a long time stirring in the development device, excellent and stable developing ability can be ensured. Moreover, when this requirement is met in the case of the one-component developer, variations in toner particle diameter decrease even after toner consumption or toner supply, and toner filming to a developing roller and toner fusing to members (e.g., a blade to form a thin toner film) are prevented, and in addition, even after long-time use of a developing device (i.e., long-time stirring of developer), excellent and stable developing ability can be ensured. Thus, a high-quality image can be obtained.

When the above ratio is greater than 1.25, it becomes difficult to provide a high-resolution, high-quality image, and variations in toner particle diameter may increase after toner consumption or toner supply.

The volume-average particle diameter, and the ratio of the volume-average particle diameter to the number-average particle diameter of the toner of the present invention can be determined as described below, using a particle size analyzer Multisizer III, manufactured by Beckman Coulter, Inc. At first, 0.1 mL to 5 mL of a surfactant (e.g., alkylbenzene sulfonate) as a dispersant is added to 100 mL to 150 mL of an aqueous electrolyte solution (e.g., approximately 1% by mass aqueous sodium chloride solution). Subsequently, about 2 mg to about 20 mg of a sample is added to the aqueous electrolyte solution. The aqueous electrolyte solution with suspended sample is then dispersed for about 1 minute to about 3 minutes with an ultrasonic disperser, and the volumes and numbers of toner particles are measured using a 100 μm-aperture to obtain a volume distribution and a number distribution. From these distributions, the volume-average particle diameter and number-average particle diameter of the toner can be found.

Developer

A developer of the present invention contains a toner of the present invention and may further contain appropriately selected additional components such as carrier.

Thus, the developer has excellent transferability, charging ability and is capable of stably forming high-quality images. The developer may be a one-component developer or two-component developer and it is preferably a two-component developer for its long life when used in high-speed printers corresponding to recent high information processing speed.

When the developer is used as a one-component developer, variations in toner particle diameter are small, even after toner consumption or toner supply, and toner filming to a development roller and toner fusing to members (e.g., a blade for forming a thin toner film) are prevented, and in addition, even after long-time use of the development device (i.e., long-time stirring of developer), excellent developing ability can be ensured and excellent images are obtained in a stable manner.

When the developer is used as a two-component developer, even after a long-time toner consumption and toner supply, variations in toner particle diameter are small, and even after long-time stirring in a development device, excellent developing ability can be ensured and excellent images are obtained in a stable manner.

When the toner is used for a two-component developer, the toner may be mixed with the carrier. The amount of the carrier in the two-component developer is not particularly limited and may be appropriately selected depending on the intended purpose. It is preferably 90% by mass to 98% by mass, more preferably 93% by mass to 97% by mass.

Carrier

The carrier is not particularly limited and may be appropriately selected depending on the intended purpose. The carrier preferably has a core material and a resin layer covering the core material.

Core Material

The material of the core material is not particularly limited and may be appropriately selected depending on the intended purpose. Examples thereof include manganese-strontium material or manganese-magnesium material (50 emu/g to 90 emu/g). For the purpose of securing image density, high magnetization material such as iron powder (100 emu/g or more) or magnetite (75 emu/g to 120 emu/g) is preferably used. Moreover, a low magnetization material such as copper-zinc with 30 emu/g to 80 emu/g is preferably used, because the impact toward the photoconductor, on which developer particles are held in an upright position, can be relieved and because it is advantageous for improvement of image quality.

These materials may be used alone or in combination.

The volume-average particle diameter of the core material is not particularly limited and may be appropriately selected depending on the intended purpose. It is preferably 10 μm to 150 μm, more preferably 40 μm to 100 μm. When the volume-average particle diameter is less than 10 μm, the amount of fine carrier powder increases, whereas magnetization per particle decreases and carrier scattering may occur. When the volume-average particle diameter is greater than 150 μm, the specific surface area decreases and thus toner scattering may occur; therefore, in the case of printing a full-color image with many solid portions, especially the solid portions may be poorly reproduced.

Resin Layer

The material of the resin layer is not particularly limited and may be appropriately selected from known resins depending on the intended purpose. Examples thereof include amino resins, polyvinyl resins, polystyrene resins, polyhalogenated olefins, polyester resins, polycarbonate resins, polyethylene, polyvinyl fluoride, polyvinylidene fluoride, polytrifluoroethylene, polyhexafluoropropylene, copolymers of vinylidene fluoride and acrylic monomer, copolymers of vinylidene fluoride and vinyl fluoride, fluoroterpolymers such as terpolymers of tetrafluoroethylene, vinylidene fluoride and monomer having no fluoro group, and silicone resins.

These may be used alone or in combination.

The amino resins are not particularly limited and may be appropriately selected depending on the intended purpose. Examples thereof include urea-formaldehyde resins, melamine resins, benzoguanamine resins, urea resins, polyamide resins, and epoxy resins.

The polyvinyl resins are not particularly limited and may be appropriately selected depending on the intended purpose. Examples thereof include acrylic resins, polymethyl methacrylate, polyacrylonitrile, polyvinyl acetate, polyvinyl alcohol, and polyvinyl butyral.

The polystyrene resins are not particularly limited and may be appropriately selected depending on the intended purpose. Specific examples thereof include polystyrene and styrene-acrylic copolymers.

The polyhalogenated olefins are not particularly limited and may be appropriately selected depending on the intended purpose. Examples thereof include polyvinyl chloride.

The polyester resins are not particularly limited and may be appropriately selected depending on the intended purpose. Examples thereof include polyethylene terephtalate and polybutylene terephtalate.

The resin layer may contain conductive powder or the like, if necessary. The conductive powder is not particularly limited and may be appropriately selected depending on the intended purpose. Examples thereof include metal powder, carbon black, titanic oxide, tin oxide, and zinc oxide. The average particle diameter of these conductive powders is preferably 1 μm or less. When the average particle diameter is greater than 1 μm, it may be difficult to control the electrical resistance.

The resin layer may be formed by uniformly coating a surface of the core material with a coating solution, which is prepared by dissolving a silicone resin or the like in a solvent, by a known coating method, followed by drying and baking.

The coating method is not particularly limited and may be appropriately selected depending on the intended purpose. Examples thereof include dipping, spraying, and brushing.

The solvent not particularly limited and may be appropriately selected depending on the intended purpose. Examples thereof include toluene, xylene, methyl ethyl ketone, methyl isobutyl ketone, and butyl cellosolve acetate.

The baking is not particularly limited and may be external heating or internal heating. Examples of baking methods include methods using fixed electric furnace, fluid electric furnace, rotary electric furnace, or burner furnace, and methods using microwaves.

The amount of the resin layer in the carrier is not particularly limited and may be appropriately selected depending on the intended purpose. It is preferably 0.01% by mass to 5.0% by mass. When the amount is less than 0.01% by mass, the resin layer may not be uniformly formed over the surface of the core material. When the amount is more than 5.0% by mass, the resin layer becomes so thick that fusing of carrier particles occurs, possibly causing decrease in uniformity in carrier particle size.

Image Forming Method

The image forming method of the present invention includes at least a latent electrostatic image forming step, a developing step, a transfer step and a fixing step, and preferably further includes a cleaning step. If necessary, it may further include appropriately selected other steps such as a charge-eliminating step, a recycling step and a controlling step.

An image forming apparatus used in the present invention includes at least a latent electrostatic image bearing member, a latent electrostatic image forming unit, a developing unit, a transfer unit and a fixing unit, and preferably further includes a cleaning unit. If necessary, it may further include appropriately selected other units such as a charge-eliminating unit, a recycling unit and a controlling unit.

The image forming method of the present invention can be performed using the image forming apparatus used in the present invention: the latent electrostatic image forming step can be performed using the latent electrostatic image forming unit; the developing step can be performed using the developing unit; the transfer step can be performed using the transfer unit; the fixing step can be performed using the fixing unit; and other steps can be performed respectively using the other units.

In the image forming method, it is preferred that the latent electrostatic image forming step be a step of forming latent electrostatic images respectively on a plurality of latent electrostatic image bearing members, that the developing step be a step of developing the latent electrostatic images using different colors for respective latent electrostatic image bearing members so as to form visible images (toner images), and that the transfer step be a step of transferring the visible images via an intermediate transfer medium to a recording medium.

Latent Electrostatic Image Forming Step

The latent electrostatic image forming step is a step of forming a latent electrostatic image on a latent electrostatic image bearing member such as a photoconductive insulator, a photoconductor or the like. In the latent electrostatic image bearing member, its material, shape, structure, and size, etc. are not particularly limited and may be appropriately selected from those known in the art. It preferably has a drum shape. The photoconductor is not particularly limited and may be appropriately selected depending on the intended purpose. Also, the photoconductor is made, for example, of inorganic photoconductor materials (e.g., amorphous silicon and selenium) and organic photoconductor materials (e.g., polysilane and phthalopolymethine). Of these, amorphous silicon photoconductors, etc. are preferably used in terms of attaining a long service life.

The latent electrostatic image can be formed using the latent electrostatic image forming unit, for example, in such a manner that a surface of the latent electrostatic image bearing member is uniformly charged and then imagewise exposed. The latent electrostatic image forming unit includes at least a charging device for uniformly charging the surface of the latent electrostatic image bearing member by application of voltage, and an exposing device for imagewise exposing the surface of the latent electrostatic image bearing member.

The charging device is not particularly limited, and may be appropriately selected depending on the intended purpose. Examples thereof include known contact charging devices each having a conductive or semi-conductive roller, brush, film, or rubber blade, and non-contact charging devices each employing corona discharge (e.g., a corotron and a scorotron).

The exposing device is not particularly limited, and may be appropriately selected depending on the intended purpose, as long as it can perform imagewise-exposure so as to form an image of interest on the latent electrostatic image bearing member surface which has been charged by the charging device. Examples thereof include various exposing devices such as copy optical systems, rod lens array systems, laser optical systems and liquid crystal shutter optical systems. Notably, exposure may be performed by imagewise exposing the latent electrostatic image bearing member from the backside thereof.

Developing Step

The developing step is a step of developing the latent electrostatic image using the toner so as to form a visible image (toner image) using a developing unit. The developing unit is not particularly limited, and may be appropriately selected depending on the intended purpose, as long as development can be performed using the toner. Examples thereof include developing devices each having a developer container which accommodates the developer and which can apply the toner to the latent electrostatic image in a contact or non-contact manner. It is preferred that developing devices each have a developer container.

The developing device is not particularly limited, and may be appropriately selected depending on the intended purpose. Examples thereof include those having a stirrer frictionally charging the developer and a rotatable magnetic roller. In the developing device, the toner and carrier are stirred so that the toner is charged by friction generated therebetween. The charged toner is held in an upright position on the surface of the rotating magnetic roller to form a magnetic brush. The magnetic roller is disposed in the vicinity of the latent electrostatic image bearing member and thus, some of the toner forming the magnetic brush are electrically adsorbed onto the surface of the latent electrostatic image bearing member. As a result, the latent electrostatic image is developed with the toner, to thereby form a toner image on the surface of the latent electrostatic image bearing member.

Transfer Step

The transfer step is a step of transferring the toner image onto a recording medium by charging, using a transfer charging device, the latent electrostatic image bearing member on which the toner image has been formed, and the transfer step can be performed using the transfer unit. Preferably, the transfer step includes a primary transfer step of transferring a toner image onto an intermediate transfer medium, and a secondary transfer step of transferring the toner image from the intermediate transfer medium onto a recording medium. In the transfer step, toners of two or more colors are used, and preferably a full color toner is used. Thus, more preferably, the transfer step includes a primary transfer step of transferring each toner image onto an intermediate transfer medium so as to form a composite toner image; and a secondary transfer step of transferring the composite toner image from the intermediate transfer medium onto a recording medium.

The transfer unit preferably includes a primary transfer unit for transferring the toner image onto the intermediate transfer medium so as to form a composite transfer image; and a secondary transfer unit for transferring the composite toner image from the intermediate transfer medium onto a recording medium. The intermediate transfer medium is not particularly limited, and may be appropriately selected depending on the intended purpose. Examples thereof include endless transfer belts. The transfer unit (primary transfer unit and the secondary transfer unit) preferably includes a transfer device which separates the toner image by charge from a latent electrostatic image bearing member onto a recording medium. The transfer unit may include one or more transfer devices.

The transfer device is not particularly limited and may be appropriately selected depending on the intended purpose. Examples thereof include corona transfer devices employing corona discharge, transfer belts, transfer rollers, press transfer rollers and adhesive transfer devices.

The recording medium is not particularly limited and may be appropriately selected from known recording media (recording paper or sheets) depending on the purpose.

Fixing Step

The fixing step is a step of fixing the toner image which has been transferred onto the recording medium by a fixing belt system. The fixing unit used for the fixing belt system is not particularly limited, and may be appropriately selected depending on the intended purpose. Examples thereof include a combination of a heating roller, a pressing roller and an endless belt. The heating temperature for the fixing belt system is generally 80° C. to 200° C.

Charge-Eliminating Step

The charge-eliminating step is a step of eliminating charges by applying a charge-eliminating bias to the latent electrostatic image bearing member, and can be performed by the charge-eliminating unit. The charge-eliminating unit is not particularly limited, and may be appropriately selected depending on the intended purpose, as long as it can apply a charge-eliminating bias to the latent electrostatic image bearing member. Examples thereof include a charge-eliminating lamp.

Cleaning Step

The cleaning step is a step of removing the toner remaining on the latent electrostatic image bearing member, and can be performed using the cleaning unit. The cleaning unit is not particularly limited, and may be appropriately selected depending on the intended purpose, as long as it can remove the toner remaining on the latent electrostatic image bearing member. Examples thereof include a magnetic blush cleaner, an electrostatic brush cleaner, a magnetic roller cleaner, a blade cleaner, a brush cleaner or a web cleaner.

Recycling Step

The recycling step is a step of recycling the toner removed in the cleaning step to the developing unit, and can be performed using the recycling unit. The recycling unit is not particularly limited, and may be appropriately selected depending on the intended purpose. For example, a known conveying unit may be used.

Controlling Step

The controlling step is a step of controlling each of the above steps, and can be performed using the controlling unit. The controlling unit is not particularly limited, and may be appropriately selected depending on the intended purpose, as long as it can control the operation of each unit. For example, a sequencer or a computer may be used.

FIG. 1 shows an exemplary image forming apparatus used for the image forming method of the present invention. An image forming apparatus 100A includes a photoconductor drum 10 serving as the latent electrostatic image bearing member, a charging roller 20 serving as the charging unit, an exposing device serving as the exposing unit, a developing devices serving as the developing unit (i.e., a developing device for black 45K, a developing device for yellow 45Y, a developing device for magenta 45M, and a developing device for cyan 45C), an intermediate transfer medium 50, a cleaning device 60 having a cleaning blade and serving as the cleaning unit, and a charge-eliminating lamp 70 serving as the charge-eliminating unit.

The intermediate transfer medium 50 is an endless belt, and is stretched around the three rollers 51 provided in a loop of the belt, and can be driven in a direction indicated by an arrow using the three rollers 51. Some of the three rollers 51 serve also as a transfer bias roller capable of applying a predetermined transfer bias (primary transfer bias) to the intermediate transfer medium 50.

A cleaning device 90 having a cleaning blade is disposed in the vicinity of the intermediate transfer medium 50. Also, a transfer roller 80 is disposed so as to face the intermediate transfer medium 50 and serves as the transfer unit capable of applying a transfer bias for transferring (secondarily transferring) a toner image onto a recording medium 95.

Around the intermediate transfer medium 50, a corona charging device 52 for applying charges to the toner image on the intermediate transfer medium 50 is disposed between a contact portion of the intermediate transfer medium 50 with the photoconductor drum 10 and a contact portion of the intermediate transfer medium 50 with the recording medium 95.

The developing devices for black (K), yellow (Y), magenta (M) and cyan (C) i.e., a developing device for black 45K, a-developing device for yellow 45Y, a developing device for magenta 45M, and a developing device for cyan 45C each contain a developer accommodating section 42K, 42Y, 42M or 42C, a developer supplying roller 43K, 43Y, 43M or 43C and a developing roller 44K, 44Y, 44M or 44C.

In the image forming apparatus 100A, the charging roller 20 uniformly charges the photoconductor drum 10. The photoconductor drum 10 is imagewise exposed to light 30 emitted from an exposing device to form a latent electrostatic image. The latent electrostatic image formed on the photoconductor drum 10 is developed with a developer supplied from each of the developing devices (i.e., the developing device for black 45K, the developing device for yellow 45Y, the developing device for magenta 45M, and the developing device for cyan 45C), to thereby form a toner image. The toner image is transferred onto the intermediate transfer medium 50 (primary transfer) with a transfer bias applied from the rollers 51. The toner image transferred onto the intermediate transfer medium 50 is charged with a corona charging device 52 and then is transferred onto the recording medium 95 (secondary transfer). Notably, the toner remaining on the photoconductor drum 10 are removed by the cleaning device 60, and charges on the photoconductor drum 10 are removed by the charge-eliminating lamp 70.

Figure 2:
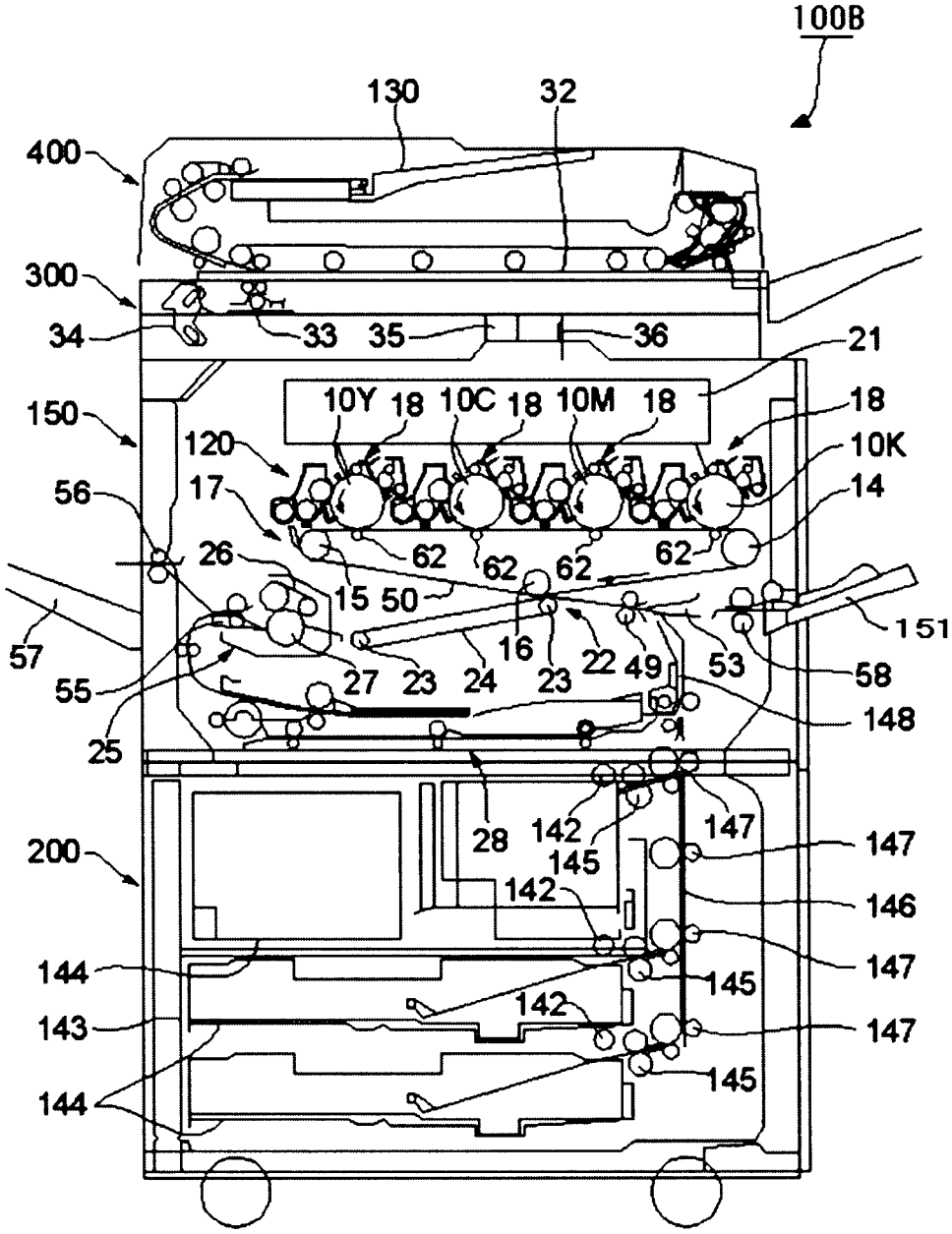
FIG. 2 shows another exemplary image forming apparatus used in an image forming method of the present invention.

FIG. 2 shows another exemplary image forming apparatus used in the image forming method of the present invention. An image forming apparatus 100B is a tandem color image forming apparatus, and includes a copying device main body 150, a paper feeding table 200, a scanner 300 and an automatic document feeder (ADF) 400.

The copying device main body 150 is provided at its center portion with an endless belt-shaped intermediate transfer medium 50. The intermediate transfer medium 50 can be rotated by support rollers 14, 15 and 16 in a direction indicated by an arrow.

Figure 3:
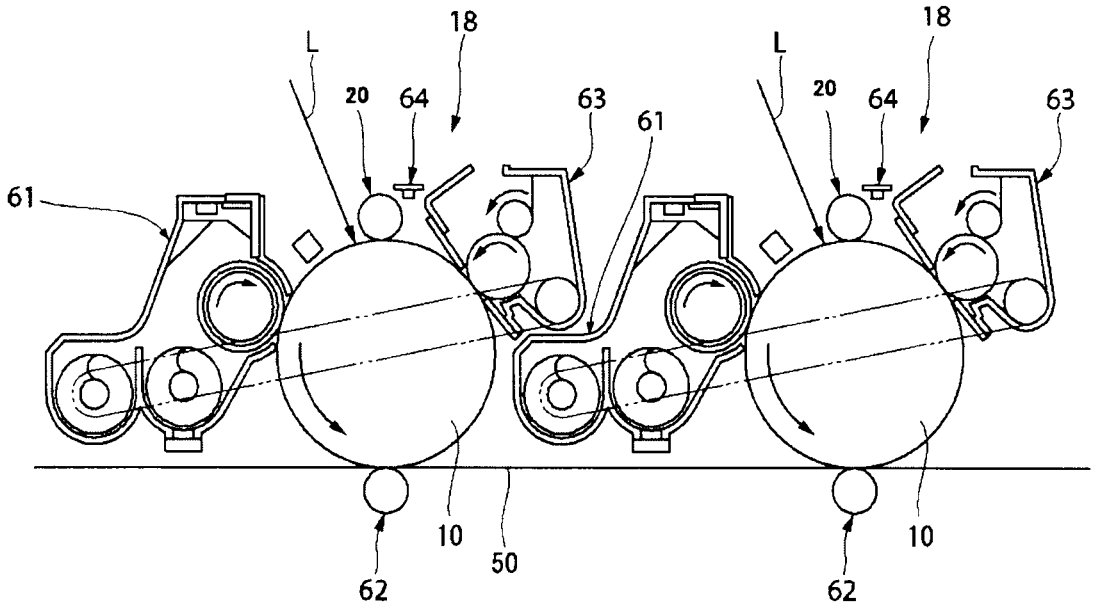
FIG. 3 is a partially enlarged schematic view of the image forming apparatus shown in FIG. 2.

A cleaning device 17 for removing the toner remaining on the intermediate transfer medium 50 is disposed in the vicinity of the support roller 15. Around the intermediate transfer medium 50 tightly stretched by support rollers 14 and 15 is provided a tandem developing device 120 in which four image forming units 18 for yellow, cyan, magenta and black are arranged in a row along a moving direction of the intermediate transfer medium. As shown in FIG. 3, each image forming unit 18 has a photoconductor drum 10, a charging roller 20 which uniformly charges the photoconductor drum 10, a developing device 61 which forms a toner image by developing a latent electrostatic image on the photoconductor drum 10 with a developer of black (K), yellow (Y), magenta (M) or cyan (C), a transfer roller 62 which transfers the toner image onto an intermediate transfer medium 50, a cleaning device 63, and a charge-eliminating lamp 64.

An exposing device 21 is provided in the vicinity of the tandem developing device 120. The exposing device 21 applies light L to the photoconductor drum 10 (i.e., a photoconductor for black 10K, a photoconductor for yellow 10Y, a photoconductor for magenta 10M, or a photoconductor for cyan 10C) to form a latent electrostatic image.

Also, a secondary transfer device 22 is provided on the intermediate transfer medium 50 on the side opposite to the side where the tandem developing device 120 is disposed. The secondary transfer device 22 includes an endless belt-shaped secondary transfer belt 24 and a pair of support rollers 23 tightly stretching the belt. A recording sheet fed on the secondary transfer belt 24 can come into contact with the intermediate transfer medium 50.

A fixing device 25 is provided in the vicinity of the secondary transfer device 22. The fixing device 25 includes an endless-shaped fixing belt 26 and a press roller 27 provided so as to be pressed against the fixing belt 26.

Also, a sheet reversing device 28 for reversing a recording sheet when image formation is performed on both sides of the recording sheet is disposed in the vicinity of the secondary transfer device 22 and the fixing device 25.

Next will be described formation of a full color image (color copy) using the image forming apparatus 100B. First, an original document is set on a document table 130 of the automatic document feeder (ADF) 400. Alternatively, the automatic document feeder 400 is opened and then an original document is set on a contact glass 32 of the scanner 300, followed by closing of the automatic document feeder 400. In the former case, when a starting switch is pressed, the scanner 300 is operated to run a first carriage 33 and a second carriage 34 after the original document has been transferred onto the contact glass 32. In the latter case, when a starting switch is pressed, the scanner 300 is operated to run a first carriage 33 and a second carriage 34 immediately after the original document has been set on the contact glass 32. At that time, the first carriage 33 irradiates the original document with light from a light source, and then the second carriage 34 reflects, on its mirror, light reflected by the original document. The thus-reflected light is received by a reading sensor 36 through an imaging lens 35 for reading the original document (color image), to thereby form image information corresponding to black, yellow, magenta and cyan.

Further, based on the thus-formed image information, a latent electrostatic image corresponding to each color is formed on the photoconductor drum 10 with the exposing device 21. Subsequently, the latent electrostatic image is developed with a developer supplied from a developing device 61 for each color toner, to thereby form color toner images. The thus-formed color toner images are sequentially superimposed (primarily transferred) on the intermediate transfer medium 50 which is being rotated by support rollers 14, 15 and 16, whereby a composite toner image is formed on the intermediate transfer medium 50.

In the paper feeding table 200, one of paper feeding rollers 142 is selectively rotated to feed recording sheets from one of vertically stacked paper feeding cassettes 144 housed in a paper bank 143. The thus-fed sheets are separated from one another by a separating roller 145. The thus-separated sheet is fed through a paper feeding path 146, then fed through a paper feeding path 148 in a copying device main body 150 by a transfer roller 147, and stopped at a registration roller 49. Alternatively, a recording sheet placed on a manual-feeding tray 151 is fed, and the thus-fed sheets are separated from one another by a separating roller 58. The thus-separated sheet is fed through a manual paper-feeding path 53 and then stopped at the registration roller 49. The registration roller 49 is generally used in a grounded state. Alternatively, it may be used while a bias is being applied thereto for removing paper dust from the sheet.

The registration roller 49 is rotated synchronously with the movement of a composite toner image formed on the intermediate transfer medium 50 to convey the recording sheet into between the intermediate transfer medium 50 and the secondary transfer device 22, to thereby transfer (secondarily transfer) the composite toner image onto the recording sheet.

The recording sheet, on which the composite toner image is transferred, is fed by the secondary transfer device 22 to a fixing device 25. In the fixing device 25, the fixing belt 26 and the press roller 27 fix the composite toner image on the recording sheet through application of heat and pressure. Subsequently, the recording sheet is switched by a switching claw 55, and then discharged from a discharge roller 56 and then stacked on a discharge tray 57. Alternatively, the recording sheet is switched by the switching claw 55, and then reversed with the sheet reversing device 28 and conveyed again to a position where transfer is performed. Thereafter, an image is formed on the back surface of the recording sheet, and then the thus-obtained sheet is discharged from a discharge roller 56 and stacked on the discharge tray 57.

Notably, the cleaning device 17 removes the toner remaining on the intermediate transfer medium 50 after transfer of the composite toner image.

The ranges described above in the detailed description of the invention section include all specific values and subranges therebetween.

EXAMPLES

The present invention will be described in more detail with reference to the following Examples and Comparative Examples. However, it should be noted that the present invention is not limited to these Examples and Comparative Examples.

Synthesis Example 1

Synthesis of Unmodified Polyester Resin A (PE resin A)

Into a reaction vessel equipped with a condenser, a stirrer, and a nitrogen-introducing tube, 67 parts by mass of bisphenol A ethylene oxide (2 mol) adduct, 84 parts by mass of bisphenol A propion oxide (3 mol) adduct, 274 parts by mass of terephthalic acid, and 2 parts by mass of dibutyltin oxide were charged, allowing the resultant mixture to react for 8 hours at 230° C. under normal pressure, so as to obtain a reaction liquid. Subsequently, the reaction liquid was allowed to react for 5 hours under reduced pressure of 10 mmHg to 15 mmHg, to thereby synthesize Unmodified Polyester Resin A (PE resin M. The thus-obtained Unmodified Polyester Resin A had an acid value of 15.3 KOHmg/g, and a softening point of 95° C.

Synthesis Example 2

Synthesis of Unmodified Polyester Resin B (PE resin B)

Into a reaction vessel equipped with a condenser, a stirrer, and a nitrogen-introducing tube, 77 parts by mass of bisphenol A ethylene oxide (2 mol) adduct, 74 parts by mass of bisphenol A propion oxide (3 mol) adduct, 289 parts by mass of terephthalic acid, and 2 parts by mass of dibutyltin oxide were charged, allowing the resultant mixture to react for 10 hours at 230° C. under normal pressure, so as to obtain a reaction liquid. Subsequently, the reaction liquid was allowed to react for 6 hours under reduced pressure of 10 mmHg to 15 mmHg, to thereby synthesize Unmodified Polyester Resin B (PE resin B). The thus-obtained Unmodified Polyester Resin B had an acid value of 4.7 KOHmg/g, and a softening point of 118° C.

Synthesis Example 3

Synthesis of Unmodified Polyester Resin C (PE resin C)

Into a reaction vessel equipped with a condenser, a stirrer, and a nitrogen-introducing tube, 82 parts by mass of bisphenol A ethylene oxide (2 mol) adduct, 69 parts by mass of bisphenol A propion oxide (3 mol) adduct, 294 parts by mass of terephthalic acid, and 2 parts by mass of dibutyltin oxide were charged, allowing the resultant mixture to react for 8 hours at 230° C. under normal pressure, so as to obtain a reaction liquid. Subsequently, the reaction liquid was allowed to react for 6 hours under reduced pressure of 10 mmHg to 15 mmHg, to thereby synthesize Unmodified Polyester Resin C (PE resin C). The thus-obtained Unmodified Polyester Resin C had an acid value of 46 KOHmg/g, and a softening point of 123° C.

Synthesis Example 4

Synthesis of Isocyanate Group-Containing Polyester Resin

Into a reaction vessel equipped with a condenser, a stirrer, and a nitrogen-introducing tube, 682 parts by mass of bisphenol A ethylene oxide (2 mol) adduct, 81 parts by mass of bisphenol A propylene oxide (2 mol) adduct, 283 parts by mass of terephthalic acid, 22 parts by mass of trimellitic anhydride, and 2 parts by mass of dibutyltin oxide were charged, allowing the resultant mixture to react for 8 hours at 230° C. under normal pressure. Subsequently, the reaction mixture was allowed to react for 5 hours under reduced pressure of 10 mmHg to 15 mmHg, to thereby synthesize an intermediate polyester.

The thus-obtained intermediate polyester had a number average molecular weight (Mn) of 2,100, a weight average molecular weight (Mw) of 9,500, a glass transition temperature, Tg, of 55° C., an acid value of 0.5 mgKOH/g, and a hydroxyl group value of 51 mgKOH/g.

Subsequently, into a reaction vessel equipped with a condenser, a stirrer, and a nitrogen-introducing tube, 410 parts by mass of the intermediate polyester, 89 parts by mass of isophorone diisocyanate, and 500 parts by mass of ethyl acetate were charged, allowing the resultant mixture to react for 5 hours at 100° C., to thereby synthesize an isocyanate group-containing polyester resin, i.e., a polymer having a site reactive with an active hydrogen group-containing compound.

The thus-obtained isocyanate group-containing polyester resin had a free isocyanate content of 1.53% by mass.

Synthesis Example 5

Synthesis of Ketimine Compound (Active Hydrogen Group-Containing Compound)

In a reaction vessel equipped with a stirring rod and a thermometer, 170 parts by mass of isophorone diamine and 75 parts by mass of methyl ethyl ketone were charged, allowing the resultant mixture to react at 50° C. for 5 hours to synthesize a ketimine compound (active hydrogen group-containing compound).

The obtained ketimine compound (active hydrogen group-containing compound) had an amine value of 418 mgKOH/g.

Measurement

The acid values and softening points of Unmodified Polyester Resins A to C were measured as follows. The acid values and melting points of pigment dispersants described below were measured as follows.

Measurement of Acid Value

An acid value was measured in accordance with the measurement method described in JIS K0070-1992 under the following conditions.

Sample preparation: 0.5 g of a sample was added to 120 mL of toluene and stirred for about 10 hours at room temperature (23° C.) so as to dissolve the sample in the toluene, and then 30 mL of ethanol was added to the mixture, to thereby prepare a sample solution.

The acid value could be measured using the aforementioned instrument. Specifically, the acid value was obtained as follows:

The sample solution was titrated with N/10 potassium hydroxide solution and alcohol solution previously standardized. Based on the consumption amounts of the alcohol solution and potassium hydroxide solution, the amine value was calculated from the following equation:

$$\text{Acid value}=\text{KOH(mL)}\times N\times 56.1/\text{sample mass}$$

where N is a factor of N/10 KOH.

Method for Measuring Softening Point

Using a flowmeter (CFT-500D, manufactured by SHIMADZU CORPORATION), a load of 1.96 MPa was applied to 1 g of a sample using a plunger while the sample was heated at 6° C./min, so as to extrude the sample through a nozzle having a diameter of 1 mm and a length of 1 mm.

The plunger descent amount of the flowmeter was plotted with respect to the temperature, and the temperature at which half quantity of the sample had been flowed out was determined as a softening point.

Method for Measuring Melting Point

In a differential scanning calorimetry (DSC), a melting point was determined by a peak top indicating the maximum endotherm of a DSC curve. The melting point was measured using TA-60WS and DSC-60 (manufactured by Shimadzu Corporation) under the following conditions. The melting point was obtained from a DSC curve of the second heating in the following measurement conditions.

Measurement Conditions

Sample container: aluminum sample pan (with a lid)
Sample amount: 5 mg
Reference: aluminum sample pan (10 mg of alumina)
Atmosphere: nitrogen (flow rate: 50 mL/min)
Temperature conditions:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

Example 1

Preparation of Toner

Preparation of Mixed Crystal-Containing Mixture A

C. I. Pigment Yellow 185 (manufactured by DIC Corporation) (80 parts by mass) and 20 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture A. The presence of the mixed crystal was confirmed from a crystalline peak obtained by X-ray diffraction analysis.

Preparation of Masterbatch A

Unmodified Polyester Resin A (PE resin A) (55 parts by mass), 40 parts by mass of Mixed Crystal-Containing Mixture A, and 5 parts by mass of montan acid ester (LICOWAX E, manufactured by Clariant, melting point: 84° C., acid value: 12.4 KOHmg/g) were mixed using a HENSCHEL MIXER (manufactured by NIPPON COKE & ENGINEERING COMPANY, LIMITED) at 1,000 rpm for 5 minutes, followed by kneading the mixture using an open roll kneader (manufactured by NIPPON COKE & ENGINEERING COMPANY, LIMITED), and then the mixture was pulverized using a rotoplex granulator, to thereby obtain a colorant (pigment) dispersion powder whose particles having an average particle diameter of 2 mm. This was referred to as Masterbatch A.

Preparation of Toner Material Liquid (Oil Phase)

In a beaker, 10 parts by mass of the isocyanate group-containing polyester resin obtained in Synthesis Example 4, 75 parts by mass of Unmodified Polyester Resin A (PE resin A), and 130 parts by mass of ethyl acetate were charged, and stirred so as to dissolve the isocyanate group-containing polyester resin and Unmodified Polyester Resin A (PE resin A) in the ethyl acetate. Then, 5 parts by mass of paraffin wax, 17 parts by mass of Masterbatch A were added into the beaker. The resultant mixture was treated with a bead mill (ULTRA VISCOMILL, manufactured by AIMEX CO., Ltd.) under the following conditions: a liquid feed rate of 1 kg/hr, disc circumferential velocity of 6 m/s, zirconia beads each having a diameter of 0.5 mm packed to 80% by volume, and 3 passes. Further, 2.7 parts by mass of the ketimine compound was added and dissolved into the mixture, to thereby prepare a toner material liquid (oil phase).

Preparation of Emulsified Slurry

Water (990 parts by mass), 83 parts by mass of a resin particle dispersion liquid and 37 parts by mass of a 48.5% by mass aqueous solution of sodium dodecyldiphenyl ether disulfonate (ELEMINOL MON-7, manufactured by Sanyo Chemical Industries, Ltd.), 135 parts by mass of an aqueous solution of 1% by mass of sodium carboxymethylcellulose (polymer dispersant), SEROGEN BS-H-3 (manufactured by Dai-ichi Kogyo Seiyaku Co., Ltd.), and 90 parts by mass of ethyl acetate were mixed and stirred, to thereby obtain an aqueous medium.

Into a vessel 150 parts by mass of the aqueous medium was charged, and then stirred at 12,000 rpm with a TK homomixer (manufactured by Tokushu Kika Kogyo Co., Ltd.). Subsequently, 100 parts by mass of the toner material liquid (oil phase) was added to the thus-treated aqueous medium, followed by mixing for 10 minutes to thereby prepare an emulsified slurry.

Preparation of Dispersion Slurry

Into a flask equipped with a stirrer and a thermometer, 100 parts by mass of the emulsified slurry was charged. Then, the solvent was removed for 12 hours at 30° C. with stirring at a circumferential speed of 20 m/min, to thereby prepare a dispersion slurry.

Preparation of Filter Cake

The dispersion slurry (100 parts by mass) was filtrated under reduced pressure. Thereafter, ion-exchanged water (100 parts by mass) was added to the filter cake, and then mixed with a TK Homomixer at 12,000 rpm for 10 minutes, followed by filtration. To the filter cake ion-exchanged water (300 parts by mass) was added, and mixed with a TK Homomixer at 12,000 rpm for 10 minutes, and then the mixture was filtered, followed by repeating this process one more time. Subsequently, a 10% by mass aqueous sodium hydroxide solution (20 parts by mass) was added to the filter cake, and mixed with a TK Homomixer at 12,000 rpm for 30 minutes, followed by filtration under reduced pressure. Then, ion-exchanged water (300 parts by mass) was added to the filter cake, and mixed with a TK Homomixer at 12,000 rpm for 10 minutes, followed by filtration. To the filter cake ion-exchanged water (300 parts by mass) was added, and mixed with a TK Homomixer at 12,000 rpm for 10 minutes, and then the mixture was filtered, followed by repeating this process one more time. Further, 10% by mass hydrochloric acid (20 parts by mass) was added to the resultant filtration cake, and mixed using a TK HOMOMIXER at 12,000 rpm for 10 minutes, followed by filtration. To the further resultant filter cake ion-exchanged water (300 parts by mass) was added, and mixed with a TK Homomixer at 12,000 rpm for 10 minutes, and then the mixture was filtered, followed by repeating this process one more time, to thereby obtain a final filter cake.

Preparation of Toner

The thus obtained final filter cake was dried with a circular wind dryer at 45° C. for 48 hr. The dried product was sieved through a sieve with 75 μm-mesh opening, to thereby obtain toner base particles. To the toner base particles (100 parts by mass), as external additives 1.0 part of a hydrophobic silica and 0.5 parts by mass of hydrophobic titanium oxide were added, and mixed with a HENSCHEL MIXER (manufactured by NIPPON COKE & ENGINEERING COMPANY, LIMITED) to prepare a toner.

The amount of the colorant was 7 parts by mass, relative to 100 parts by mass of the binder resin (the unmodified polyester resin and the isocyanate group-containing polyester resin) in the resultant toner.

Evaluation

The following evaluation was performed with respect to the resultant toner. The results are shown in Table 2.

Evaluation of Color Reproducibility

Each of the resultant toners and a ferrite carrier having a diameter of 60 μm were stirred and mixed for 20 minutes so that a toner concentration became 4% by mass, to thereby form a two-component developer. The two-component developer was charged into a copier (IMAGIO NEO C355, manufactured by Ricoh Company, Ltd.), and adjusted so as to adhere onto TOKUHISHI ART N (110 kg) (manufactured by Mitsubishi Paper Mills Ltd.) in an adhesion amount of 0.4 $mg/cm^2$. Thereafter, a fixing member was controlled at a temperature of 160° C., and then a solid image in a size of 5 cm×5 cm was printed on 100 sheets at a leaner velocity of 280 mm/sec. Thereafter, a solid image in a size of 5 cm×5 cm was printed on 3 sheets in the above described manner, to thereby obtain image samples for evaluation.

With respect to the image samples, chromaticness indexes a* and b* in L*a*b* color system (CIE: 1976) were measured using a color measurement instrument (X-Rite 938, manufactured by X-Rite, Incorporated), and then a value of C* was determined by the following Equation (1), and a chroma of the toner was evaluated.

$$C^*=[(a^*)^2+(b^*)^2]^{1/2} \quad \text{Equation (1)}$$

The evaluation criteria of the chroma are as follows.

A: Excellent; C* was 100 or more.

B: Good; C* was 95 or more and less than 100.

C: Slightly poor; C* was 90 or more and less than 95.

D: Poor; C* was less than 90.

Five points were measured in each of the image samples, and average value "a" of C*s of the five points was calculated. The average values "a" of the respective three image samples were averaged, to thereby determine C* in the evaluation criteria.

A color difference between the calculated L*a*b* and the Japan Color was calculated from the following Equation (2), and then a value ΔE was evaluated.

$$\Delta E=[(\Delta L^*)^2+(\Delta a^*)^2+(\Delta b^*)^2]^{1/2} \quad \text{Equation (2)}$$

The evaluation criteria for the color difference are as follows.

A: Excellent; ΔE was less than 1.

B: Good; ΔE was 1 or more and less than 3.

D: Poor; ΔE was 3 or more.

Evaluation of Coloring Performance

In the same manner as in the evaluation of color reproducibility, five points in a solid image of each image sample were measured using a color measurement instrument (X-Rite 938, manufactured by X-Rite, Incorporated), and then an average value thereof was measured, followed by further averaging the average values of the respective three image samples, to thereby determine an image density.

The evaluation criteria of the image density are as follows.

A: Excellent; the image density was 1.5 or more. B: Good; the image density was 1.4 or more and less than 1.5.

C: Slightly poor; the image density was 1.3 or more and less than 1.4.

D: Poor; the image density was less than 1.3.

Test for Long-Term Running at High Temperature and High Humidity

Each of the resultant toners and a ferrite carrier having a diameter of 60 μm were stirred and mixed for 20 minutes so that a toner concentration became 4% by mass, to thereby form a two-component developer. Using a copier (IMAGIO NEO C355, manufactured by Ricoh Company, Ltd.), the printing durability of the two-component developer was tested at 40° C. and relative humidity 80%, under the following conditions: a printing density was 5%; and the number of sheets printed was 50,000. The image densities of the blank portion of the 50,000th sheet, and the blank portion of an unprinted sheet were measured using a reflection densitometer (manufactured by GretagMacbeth, converted to measure to three places of decimals). Then, the difference in the image density between the blank portion of the 50,000th sheet and the blank portion of the unprinted sheet was evaluated based on the following evaluation criteria.

A: The difference was less than 0.01.

B: The difference was 0.01 or more and less than 0.02.

C: The difference was 0.02 or more and less than 0.03.

D: The difference was 0.03 or more.

Comprehensive Evaluation

The above four evaluations were summed up, and evaluated based on the following evaluation criteria. The results are shown in Table 2.

A: In four evaluations, there was no C and/or D and there was one or more A.

B: In four evaluations, there was no D.

D In four evaluations, there was one or more D.

Example 2

Preparation of Toner

A toner was prepared in the same manner as in Example 1, except that Mixed Crystal-Containing Mixture A was replaced with Mixed Crystal-Containing Mixture B as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Mixed Crystal-Containing Mixture B

C. I. Pigment Yellow 185 (manufactured by DIC Corporation) (70 parts by mass) and 30 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture B. The presence of the mixed crystal was confirmed from a crystalline peak obtained by X-ray diffraction analysis.

Example 3

Preparation of Toner

A toner was prepared in the same manner as in Example 1, except that Mixed Crystal-Containing Mixture A was replaced with Mixed Crystal-Containing Mixture C as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Mixed Crystal-Containing Mixture C

C. I. Pigment Yellow 185 (manufactured by DIC Corporation) (60 parts by mass) and 40 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture C. The presence of the mixed crystal was confirmed from a crystalline peak obtained by X-ray diffraction analysis.

Example 4

Preparation of Toner

A toner was prepared in the same manner as in Example 1, except that the toner material liquid (oil phase) in Example 1 was replaced with the toner material liquid (oil phase) as described below.

The amount of the colorant was 7 parts by mass, relative to 100 parts by mass of the binder resin (the unmodified polyester resin) in the resultant toner.

The resultant toner was evaluated in the same manner as in Example 1. The evaluation results are shown in Table 2.

Preparation of Toner Material Liquid (Oil Phase)

Into a beaker, 85 parts by mass of Unmodified Polyester Resin A (PE resin A), and 130 parts by mass of ethyl acetate were charged, and stirred so as to dissolve Unmodified Polyester Resin A (PE resin A) in the ethyl acetate. Then, 5 parts by mass of paraffin wax, and 17 parts by mass of Masterbatch A were added into the beaker. The resultant mixture was treated with a bead mill (ULTRA VISCOMILL, manufactured by AIMEX CO., Ltd.) under the following conditions: a liquid feed rate of 1 kg/hr, disc circumferential velocity of 6 m/s, zirconia beads each having a diameter of 0.5 mm packed to 80% by volume, and 3 passes, to thereby prepare a toner material liquid (oil phase).

Example 5

Preparation of Toner

A toner was prepared in the same manner as in Example 1, except that Mixed Crystal-Containing Mixture A was replaced with Mixed Crystal-Containing Mixture D as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Mixed Crystal-Containing Mixture D

C. I. Pigment Yellow 185 (manufactured by DIC Corporation) (90 parts by mass) and 10 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture D. The presence of the mixed crystal was confirmed from a crystalline peak obtained by X-ray diffraction analysis.

Example 6

Preparation of Toner

A toner was prepared in the same manner as in Example 1, except that Mixed Crystal-Containing Mixture A was replaced with Mixed Crystal-Containing Mixture E as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Mixed Crystal-Containing Mixture E

C. I. Pigment Yellow 185 (manufactured by DIC Corporation) (55 parts by mass) and 45 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture E. The presence of the mixed crystal was confirmed from a crystalline peak obtained by X-ray diffraction analysis.

Example 7

Preparation of Toner

A toner was prepared in the same manner as in Example 1, except that in the preparation of the toner material liquid (oil phase), the amount of Masterbatch A was changed from 17 parts by mass to 9 parts by mass.

The amount of the colorant was 4 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 8

Preparation of Toner

A toner was prepared in the same manner as in Example 1, except that in the preparation of the toner material liquid (oil phase), the amount of Masterbatch A was changed from 17 parts by mass to 36 parts by mass.

The amount of the colorant was 14 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 9

Preparation of Toner

A toner was prepared in the same manner as in Example 1, except that the toner material liquid (oil phase) was replaced with the toner material liquid (oil phase) prepared without using Masterbatch A as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Toner Material Liquid (Oil Phase)

Into a beaker, 10 parts by mass of the isocyanate group-containing polyester resin obtained in Synthesis Example 4, 84.35 parts by mass of Unmodified Polyester Resin A (PE resin A), and 130 parts by mass of ethyl acetate were charged, and stirred so as to dissolve the isocyanate group-containing polyester resin and Unmodified Polyester Resin A (PE resin A) in the ethyl acetate. Then, 5 parts by mass of paraffin wax, 6.8 parts by mass of Mixed Crystal-Containing Mixture A, and 0.85 parts by mass of montan acid ester (LICOWAX E, manufactured by Clariant, melting point: 84° C., acid value: 12.4 KOHmg/g) were added into the beaker. The resultant mixture was treated with a bead mill (ULTRA VISCOMILL, manufactured by AIMEX CO., Ltd.) under the following conditions: a liquid feed rate of 1 kg/hr, disc circumferential velocity of 6 m/s, zirconia beads each having a diameter of 0.5 mm packed to 80% by volume, and 3 passes. Further, 2.7 parts by mass of the ketimine compound was added and dissolved into the mixture, to thereby prepare a toner material liquid (oil phase).

Example 10

Preparation of Toner

A toner was prepared in the same manner as in Example 1, except that the montan acid ester was replaced with carnauba wax (purified carnauba wax No-1, manufactured by CERARICA NODA Co., Ltd., melting point: 83° C., acid value: 18.7 KOHmg/g).

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 11

Preparation of Toner

A toner was prepared in the same manner as in Example 1, except that in the preparations of Masterbatch A and the toner material liquid (oil phase), Unmodified Polyester Resin A (PE resin A) was replaced with Unmodified Polyester Resin B (PE resin B).

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 12

Preparation of Toner

A toner was prepared in the same manner as in Example 1, except that in the preparations of Masterbatch A and the toner material liquid (oil phase), Unmodified Polyester Resin A (PE resin A) was replaced with Unmodified Polyester Resin C (PE resin C).

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 13

Preparation of Toner

A toner was prepared in the same manner as in Example 1, except that in the preparations of Masterbatch A and the toner material liquid (oil phase), Unmodified Polyester Resin A (PE resin A) was replaced with Unmodified Polyester Resin B (PE resin B), and that montan acid ester (LICOWAX E, manufactured by Clariant, melting point: 84° C., acid value: 12.4 KOHmg/g) was replaced with montan acid ester (CERIDUST 5551, manufactured by Clariant, melting point: 112° C., acid value: 23.1 KOHmg/g).

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 14

Preparation of Toner

A toner was prepared in the same manner as in Example 1, except that in the preparations of Masterbatch A and the toner material liquid (oil phase), Unmodified Polyester Resin A (PE resin A) was replaced with Unmodified Polyester Resin C (PE resin C), and that montan acid ester (LICOWAX E, manufactured by Clariant, melting point: 84° C., acid value: 12.4 KOHmg/g) was replaced with stearic acid ester (EXEPARL SS, manufactured by Kao Corporation, melting point: 58° C., acid value: 11 KOHmg/g).

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Example 15

Preparation of Toner

A toner was prepared in the same manner as in Example 1, except that Masterbatch A was replaced with Masterbatch B as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Masterbatch B

Unmodified Polyester Resin A (PE resin A) (59.5 parts by mass), 40 parts by mass of Mixed Crystal-Containing Mixture A, and 0.5 parts by mass of montan acid ester (LICOWAX E, manufactured by Clariant, melting point: 84° C., acid value: 12.4 KOHmg/g) were mixed using a HENSCHEL MIXER (manufactured by NIPPON COKE & ENGINEERING COMPANY, LIMITED) at 1,000 rpm for 5 minutes, followed by kneading the mixture using an open roll kneader (manufactured by NIPPON COKE & ENGINEERING COMPANY, LIMITED), and then the mixture was pulverized using a rotoplex granulator, to thereby obtain a colorant (pigment) dispersion powder whose particles having an average particle diameter of 2 mm. This was referred to as Masterbatch B.

Example 16

Preparation of Toner

A toner was prepared in the same manner as in Example 1, except that Masterbatch A was replaced with Masterbatch C as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Masterbatch C

Unmodified Polyester Resin A (PE resin A) (35 parts by mass), 40 parts by mass of Mixed Crystal-Containing Mixture A, and 25 parts by mass of montan acid ester (LICOWAX E, manufactured by Clariant, melting point: 84° C., acid value: 12.4 KOHmg/g) were mixed using a HENSCHEL MIXER (manufactured by NIPPON COKE & ENGINEERING COMPANY, LIMITED) at 1,000 rpm for 5 minutes, followed by kneading the mixture using an open roll kneader (manufactured by NIPPON COKE & ENGINEERING COMPANY, LIMITED), and then the mixture was pulverized using a rotoplex granulator, to thereby obtain a colorant (pigment) dispersion powder whose particles having an average particle diameter of 2 mm. This was referred to as Masterbatch C.

Comparative Example 1

Preparation of Toner

A toner was prepared in the same manner as in Example 1, except that Mixed Crystal-Containing Mixture A was replaced with Mixed Crystal-Containing Mixture F as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

—Preparation of Mixed Crystal-Containing Mixture F—

C. I. Pigment Yellow 185 (manufactured by DIC Corporation) (97 parts by mass) and 3 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture F. The presence of the mixed crystal was confirmed from a crystalline peak obtained by X-ray diffraction analysis.

Comparative Example 2

Preparation of Toner

A toner was prepared in the same manner as in Example 1, except that Mixed Crystal-Containing Mixture A was replaced with Mixed Crystal-Containing Mixture G as described below.

The amount of the colorant was 7 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Preparation of Mixed Crystal-Containing Mixture G

C. I. Pigment Yellow 185 (manufactured by DIC Corporation) (45 parts by mass) and 55 parts by mass of C. I. PIGMENT YELLOW 139 (manufactured by BASF) were added to diacetone alcohol, and mixed and milled with a bead mill at 40° C. for 5 hours. Thereafter, a sodium hydroxide solution was added to the milled mixture, and further diluted with hydrochloric acid, to thereby obtain Mixed Crystal-Containing Mixture G. The presence of the mixed crystal was confirmed from a crystalline peak obtained by X-ray diffraction analysis.

Comparative Example 3

Preparation of Toner

A toner was prepared in the same manner as in Example 1, except that in the preparation of the toner material liquid (oil phase), the amount of Masterbatch A was changed from 17 parts by mass to 4.5 parts by mass.

The amount of the colorant was 2 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

Comparative Example 4

Preparation of Toner

A toner was prepared in the same manner as in Example 1, except that in the preparation of the toner material liquid (oil phase), the amount of Masterbatch A was changed from 17 parts by mass to 44 parts by mass.

The amount of the colorant was 16 parts by mass, relative to 100 parts by mass of the binder resin (the unmodified polyester resin and the isocyanate group-containing polyester resin) in the resultant toner.

The resultant toner was evaluated in the same manner as in Example 1. The evaluation results are shown in Table 2.

In the preparation of the toners of Examples 1 to 16 and Comparative Examples 1 to 4, the type of the unmodified polyester resin, the presence or absence of the elongation reaction of the resin, the type of the colorant, the amount of the colorant, the presence or absence of the mixed crystal, the presence or absence of the masterbatch, the type of the pigment dispersant, and the amount of the pigment dispersant are shown in Table 1.

TABLE 1

| | Type of Unmodified Polyester Resin | Elongation reaction of the resin | Colorant (yellow pigment) C.I. Pigment Yellow 185 (% by mass) | C.I. Pigment Yellow 139 (% by mass) | Total amount of colorant (parts by mass) | Mixed crystal | Master-batch | Pigment dispersant Type | Melting point (° C.) | Acid value (KOHmg/g) | Amount (% by mass) |
|---|---|---|---|---|---|---|---|---|---|---|---|
| Ex. 1 | PE resin A | Present | 80 | 20 | 7 | Present | Present | montan acid ester | 84 | 12.4 | 5 |
| Ex. 2 | PE resin A | Present | 70 | 30 | 7 | Present | Present | montan acid ester | 84 | 12.4 | 5 |
| Ex. 3 | PE resin A | Present | 60 | 40 | 7 | Present | Present | montan acid ester | 84 | 12.4 | 5 |
| Ex. 4 | PE resin A | Absent | 80 | 20 | 7 | Present | Present | montan acid ester | 84 | 12.4 | 5 |
| Ex. 5 | PE resin A | Present | 90 | 10 | 7 | Present | Present | montan acid ester | 84 | 12.4 | 5 |
| Ex. 6 | PE resin A | Present | 55 | 45 | 7 | Present | Present | montan acid ester | 84 | 12.4 | 5 |
| Ex. 7 | PE resin A | Present | 80 | 20 | 4 | Present | Present | montan acid ester | 84 | 12.4 | 5 |
| Ex. 8 | PE resin A | Present | 80 | 20 | 14 | Present | Present | montan acid ester | 84 | 12.4 | 5 |
| Ex. 9 | PE resin A | Present | 80 | 20 | 7 | Present | Absent | montan acid ester | 84 | 12.4 | — |
| Ex. 10 | PE resin A | Present | 80 | 20 | 7 | Present | Present | carnauba wax | 83 | 18.7 | 5 |
| Ex. 11 | PE resin B | Present | 80 | 20 | 7 | Present | Present | montan acid ester | 84 | 12.4 | 5 |
| Ex. 12 | PE resin C | Present | 80 | 20 | 7 | Present | Present | montan acid ester | 84 | 12.4 | 5 |
| Ex. 13 | PE resin B | Present | 80 | 20 | 7 | Present | Present | montan acid ester | 112 | 23.1 | 5 |
| Ex. 14 | PE resin C | Present | 80 | 20 | 7 | Present | Present | stearic acid ester | 58 | 11 | 5 |
| Ex. 15 | PE resin A | Present | 80 | 20 | 7 | Present | Present | montan acid ester | 84 | 12.4 | 0.5 |
| Ex. 16 | PE resin A | Present | 80 | 20 | 7 | Present | Present | montan acid ester | 84 | 12.4 | 25 |
| Comp. Ex. 1 | PE resin A | Present | 97 | 3 | 7 | Present | Present | montan acid ester | 84 | 12.4 | 5 |
| Comp. Ex. 2 | PE resin A | Present | 45 | 55 | 7 | Present | Present | montan acid ester | 84 | 12.4 | 5 |
| Comp. Ex. 3 | PE resin A | Present | 80 | 20 | 2 | Present | Present | montan acid ester | 84 | 12.4 | 5 |
| Comp. Ex. 4 | PE resin A | Present | 80 | 20 | 16 | Present | Present | montan acid ester | 84 | 12.4 | 5 |

In Table 1, the amounts (% by mass) of C. I. PIGMENT YELLOW 185 and C. I. PIGMENT YELLOW 139 are their amounts contained in the colorant.

In Table 1, the total amount (parts by mass) of the colorant is the amount of the colorant, relative to 100 parts by mass of the binder resin.

In Table 1, the amount of the pigment dispersant (% by mass) represents the amount of the pigment dispersant in the masterbatch.

TABLE 2

| | Color reproducibility Chroma (C*) | Evaluation | Color difference (ΔE) | Evaluation | Coloring performance Image density | Evaluation | Background smear Difference in image density | Evaluation | Comprehensive evaluation |
|---|---|---|---|---|---|---|---|---|---|
| Ex. 1 | 101.5 | A | 0.85 | A | 1.55 | A | 0.008 | A | A |
| Ex. 2 | 99.2 | A | 0.26 | A | 1.53 | A | 0.007 | A | A |
| Ex. 3 | 98.5 | A | 0.2 | A | 1.51 | A | 0.006 | A | A |
| Ex. 4 | 102.1 | A | 1.05 | B | 1.57 | A | 0.008 | A | A |
| Ex. 5 | 103.2 | A | 2.5 | B | 1.61 | B | 0.005 | A | A |
| Ex. 6 | 96.3 | B | 0.56 | A | 1.46 | A | 0.008 | A | A |
| Ex. 7 | 95.3 | B | 1.8 | B | 1.43 | B | 0.005 | A | A |
| Ex. 8 | 105.8 | A | 2.9 | B | 1.65 | A | 0.013 | B | A |
| Ex. 9 | 93.8 | C | 2.4 | B | 1.41 | B | 0.015 | B | B |
| Ex. 10 | 98.8 | B | 1.5 | B | 1.48 | B | 0.011 | B | B |
| Ex. 11 | 96.3 | B | 1.8 | B | 1.45 | B | 0.013 | B | B |
| Ex. 12 | 101.5 | A | 0.77 | A | 1.57 | A | 0.027 | C | B |
| Ex. 13 | 94.2 | C | 2.1 | B | 1.42 | B | 0.013 | B | B |
| Ex. 14 | 102.1 | A | 0.81 | A | 1.58 | A | 0.024 | C | B |
| Ex. 15 | 92.6 | C | 2.7 | B | 1.38 | C | 0.005 | A | B |
| Ex. 16 | 102.8 | A | 0.55 | A | 1.63 | A | 0.028 | C | B |
| Comp. Ex. 1 | 103.8 | A | 3.2 | D | 1.63 | A | 0.006 | A | D |
| Comp. Ex. 2 | 88.4 | D | 0.2 | A | 1.31 | C | 0.008 | A | D |
| Comp. Ex. 3 | 84.2 | D | 2.3 | B | 1.27 | D | 0.006 | A | D |
| Comp. Ex. 4 | 106.8 | A | 4.2 | D | 1.68 | A | 0.015 | B | D |

According to the evaluation results, the toner of Comparative Example 1 contained high proportion of C. I. PIGMENT YELLOW 185, thus there was a large color difference between the toner and the Japan Color. The toner of Comparative Example 2 contained high proportion of C. I. PIGMENT YELLOW 139, thus the toner had a low chroma and a low coloring performance. The toner of Comparative Example 3 had an excessively low pigment density, thus the toner had a low chroma and a low coloring performance. The toner of Comparative Example 4 had a high pigment density, thus the toner had a high chroma and a high coloring performance, but there was a large color difference between the toner and the Japan Color.

On the other hand, the toners of Examples 1 to 16 were yellow toners each having a high chroma and excellent hue, hardly causing background smear in long-term running at high temperature and high humidity. Particularly, the toners of Examples 1 to 8 were excellent in the comprehensive evaluation.

The toner of the present invention has excellent transparency, light resistance and hue, high chroma and coloring performance, and less causes background smear in long-term running at high temperature and high humidity, and thus the toner can be widely used, for example, for laser printers, direct digital machines, full-color copiers using direct- or indirect-electrographic multicolor image developing system, full-color laser printers, full-color plain paper faxes, and the like.

This application claims priority to Japanese patent application No. 2010-134880, filed on Jun. 14, 2010, and incorporated herein by reference.

What is claimed is:

1. A toner comprising:

a binder resin;

a colorant; and a releasing agent, wherein the colorant comprises a mixed crystal of a C. I. PIGMENT YELLOW 185 and a C. I. PIGMENT YELLOW 139, and wherein a mass ratio of the C. I. PIGMENT YELLOW 185 to the C. I. PIGMENT YELLOW 139(mass of the C. I. PIGMENT YELLOW 185/mass of the C. I. PIGMENT YELLOW 139) in the toner is 95/5 to 50/50.

2. The toner according to claim 1, wherein an amount of the colorant is 3 parts by mass to 15 parts by mass relative to 100 parts by mass of the binder resin.

3. The toner according to claim 1, wherein the toner is obtained by dispersing, in an aqueous medium, an oil phase containing at least the binder resin, the colorant, and the releasing agent.

4. The toner according to claim 3, wherein the dispersing the oil phase in the aqueous medium comprises:

dissolving or dispersing at least an active hydrogen group-containing compound, a polymer having a site reactive with the active hydrogen group-containing compound, an unmodified polyester resin, the colorant, and the releasing agent in an organic solvent, so as to form a dissolved or dispersed product, dispersing the dissolved or dispersed product in the aqueous medium, allowing the active hydrogen group-containing compound and the polymer having a site reactive with the active hydrogen group-containing compound to undergo crosslinking reaction or elongation reaction in the aqueous medium so as to obtain a dispersion liquid, and removing the organic solvent from the dispersion liquid, wherein each of the polymer having a site reactive with the active hydrogen group-containing compound, and the unmodified polyester resin is the binder resin.

5. The toner according to claim 4, wherein the unmodified polyester resin has an acid value of 5 KOHmg/g to 40 KOHmg/g.

6. The toner according to claim 4, wherein the colorant and the unmodified polyester resin are used as a masterbatch, which is formed by dispersing the colorant in the unmodified polyester resin in the dispersing the oil phase in the aqueous medium.

7. The toner according to claim 6, wherein the colorant is dispersed using a pigment dispersant.

8. The toner according to claim 7, wherein the pigment dispersant is a fatty acid ester.

9. The toner according to claim 7, wherein the pigment dispersant has a melting point of 70° C. to 110° C.

10. The toner according to claim 7, wherein an amount of the pigment dispersant is 1% by mass to 20% by mass relative to the masterbatch.

11. The toner according to claim 6, wherein the colorant is dispersed in the unmodified polyester resin by melting and kneading the colorant and the unmodified polyester resin using an open melt-kneader.

12. The toner according to claim 1, wherein the mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) is 90/10 to 60/40.

13. The toner according to claim 1, wherein the mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) is 85/15 to 70/30.

14. A method of making the toner according to claim 1, comprising combining the binder resin, colorant and releasing agent.

15. A developer comprising a toner, wherein the toner comprises:

a binder resin;

a colorant; and a releasing agent, wherein the colorant comprises a mixed crystal of a C. I. PIGMENT YELLOW 185 and a C. I. PIGMENT YELLOW 139, and wherein a mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) in the toner is 95/5 to 50/50.

16. An image forming method comprising:

forming a latent electrostatic image on a latent electrostatic image bearing member;

developing the latent electrostatic image using a toner so as to form a visible image;

transferring the visible image onto a recording medium; and fixing the transferred image onto the recording medium, wherein the toner comprises:

a binder resin;

a colorant; and a releasing agent, wherein the colorant comprises a mixed crystal of a C. I. PIGMENT YELLOW 185 and a C. I. PIGMENT YELLOW 139, and wherein a mass ratio of the C. I. PIGMENT YELLOW 185 to the C. I. PIGMENT YELLOW 139 (mass of the C. I. PIGMENT YELLOW 185/mass of the C. I. PIGMENT YELLOW 139) in the toner is 95/5 to 50/50.

* * * * *